US010400553B2

(12) United States Patent
Bruce et al.

(10) Patent No.: US 10,400,553 B2
(45) Date of Patent: Sep. 3, 2019

(54) DOWNHOLE APPARATUS

(71) Applicant: HALLIBURTON MANUFACTURING AND SERVICES LIMITED, London (GB)

(72) Inventors: Stephen Edmund Bruce, Aberdeen (GB); David Grant, Aberdeen (GB); Scott Elliott Wallace, Aberdeen (GB)

(73) Assignee: HALLIBURTON MANUFACTURING AND SERVICES LIMITED, London (GB)

( * ) Notice: Subject to any disclaimer, the term of this patent is extended or adjusted under 35 U.S.C. 154(b) by 89 days.

(21) Appl. No.: 15/108,615

(22) PCT Filed: Dec. 29, 2014

(86) PCT No.: PCT/GB2014/053851
§ 371 (c)(1),
(2) Date: Jun. 28, 2016

(87) PCT Pub. No.: WO2015/101783
PCT Pub. Date: Jul. 9, 2015

(65) Prior Publication Data

US 2016/0326849 A1 Nov. 10, 2016

(30) Foreign Application Priority Data

Dec. 30, 2013 (GB) ..... 1323121.2

(51) Int. Cl.
*E21B 43/08* (2006.01)
*E21B 43/10* (2006.01)
(Continued)

(52) U.S. Cl.
CPC ..... *E21B 43/08* (2013.01); *E21B 23/006* (2013.01); *E21B 33/127* (2013.01); *E21B 33/14* (2013.01);
(Continued)

(58) Field of Classification Search
CPC ..... E21B 43/108; E21B 43/103; E21B 43/12; E21B 43/084; E21B 43/088
See application file for complete search history.

(56) References Cited

U.S. PATENT DOCUMENTS 2,600,173 A * 6/1952 Sewell ..... E21B 33/127 166/100
2,843,208 A * 7/1958 Blood ..... E21B 33/1243 166/100
(Continued)

FOREIGN PATENT DOCUMENTS

CN 101532378 A 9/2009
CN 202914053 U 5/2013
(Continued)

OTHER PUBLICATIONS

International Search Report and Written Opinion for International Application No. PCT/GB2014/053851 dated Sep. 30, 2015.
(Continued)

*Primary Examiner* — Kipp C Wallace

(57) ABSTRACT

A sandscreen joint is capable of providing zonal isolation. The ends of a portion of the sandscreen are capable of extension on activation of the sandscreen, including transition areas, which are coated with an elastomer sleeve. On activation of the sandscreen, the sleeve is pushed out into contact with the bore wall and serves to isolate the zone on one side of the activated sleeve from the zone on the other side of the sleeve. Thus, the sleeve on the activated sandscreen may prevent fluid from flowing axially along the bore between the bore wall and sandscreen. This may protect the weave at the transition area, preventing axial flow through the transition areas.

24 Claims, 33 Drawing Sheets

ACTIVATED

(51) Int. Cl.

| | |
|---|---|
| ***E21B 23/00*** | (2006.01) |
| ***E21B 34/10*** | (2006.01) |
| ***E21B 33/127*** | (2006.01) |
| ***E21B 33/14*** | (2006.01) |
| ***E21B 34/06*** | (2006.01) |

(52) U.S. Cl.
CPC ..... *E21B 34/06* (2013.01); *E21B 34/103* (2013.01); *E21B 43/084* (2013.01); *E21B 43/108* (2013.01)

(56) References Cited

U.S. PATENT DOCUMENTS

| | | | | |
|---|---|---|---|---|
| 3,338,311 | A | 8/1967 | Conrad | |
| 3,789,926 | A | 2/1974 | Henley et al. | |
| 6,315,040 | B1 | 11/2001 | Donnelly | |
| 6,530,431 | B1 * | 3/2003 | Castano-Mears | E21B 43/084 166/227 |
| 8,322,416 | B2 * | 12/2012 | Pop | E21B 33/1243 166/100 |
| 9,677,387 | B2 * | 6/2017 | Yhuel | E21B 43/08 |
| 2002/0129935 | A1 * | 9/2002 | Castano-Mears | E21B 43/084 166/227 |
| 2004/0261994 | A1 * | 12/2004 | Nguyen | E21B 43/088 166/278 |
| 2005/0155772 | A1 * | 7/2005 | Dusterhoft | E21B 43/084 166/381 |
| 2007/0215348 | A1 * | 9/2007 | Corre | E21B 33/1277 166/264 |
| 2009/0065199 | A1 * | 3/2009 | Patel | E21B 23/03 166/250.01 |
| 2010/0000742 | A1 * | 1/2010 | Bonner | E21B 43/08 166/378 |
| 2010/0175895 | A1 * | 7/2010 | Metcalfe | E21B 33/1277 166/382 |
| 2011/0036567 | A1 * | 2/2011 | Holderman | E21B 17/026 166/228 |
| 2012/0145389 | A1 * | 6/2012 | Fitzpatrick, Jr. | E21B 43/025 166/278 |
| 2012/0247767 | A1 | 10/2012 | Themig et al. | |
| 2013/0220606 | A1 * | 8/2013 | Yhuel | E21B 43/08 166/278 |
| 2013/0341005 | A1 * | 12/2013 | Bruce | E21B 33/1277 166/207 |
| 2016/0024897 | A1 * | 1/2016 | Greci | E21B 43/103 166/296 |

FOREIGN PATENT DOCUMENTS

| | | | |
|---|---|---|---|
| CN | 103249908 | A | 8/2013 |
| EP | 0224942 | B1 | 3/1993 |
| EP | 2176513 | A2 | 4/2010 |
| GB | 2394239 | A | 4/2004 |
| GB | 2492193 | A | 12/2012 |
| WO | 97/17524 | | 5/1997 |
| WO | 98/49423 | | 11/1998 |
| WO | 03/091537 | A1 | 11/2003 |
| WO | 2009/001069 | A2 | 12/2008 |
| WO | 2009001073 | A2 | 12/2008 |
| WO | WO-2009001069 | A2 | 12/2008 |
| WO | 2010/025152 | A1 | 3/2010 |
| WO | 2012/066290 | A2 | 5/2012 |
| WO | 2013/132254 | | 9/2013 |
| WO | 2013/186569 | | 12/2013 |

OTHER PUBLICATIONS

Tiffin, D. et al. "Evaluation of Filter Cake Flowback in Sand Control Completions" SPE International, Society of Petroleum Engineers, SPE 68933, 2001.

The State Intellectual Property Office of the People's Republic of China, Application No. 201480076251.6, First Office Action and Search Report, dated Mar. 29, 2018, 10 pages, China.

The State Intellectual Property Office of the People's Republic of China, Application No. 201480076251.6, First Office Action and Search Report, dated Mar. 29, 2018, English Translation, 12 pages, China.

* cited by examiner

Completion schematic with 3 off Darcy Screens

UNACTIVATED

ACTIVATED

UNACTIVATED

ACTIVATED

Un-activated

Chamber Inside Larger Chamber

Activated

Apply Pressure to Chambers

Inner Chamber supports/strengthens outer Chamber

Run In Hole
Sleeve locked in position

Pressure up and shear pins
Sleeve move down

Bleed off pressure
Spring pushes Sleeve back

Pressure up to Activate Screen
Sleeve moves down

Bleed off Pressure
Spring moves sleeve
Sleeve in Locked closed position

Donut - Un-activated

Donut - Activated

DOWNHOLE APPARATUS

REFERENCE TO RELATED APPLICATIONS

This application is a United States National Phase application of PCT Application No. PCT/GB2014/053851 filed on Dec. 29, 2014 which claims priority to United Kingdom Application No. 1323121.2 filed on Dec. 30, 2013.

FIELD OF THE INVENTION

This invention relates to downhole apparatus. Embodiments of the invention relate to apparatus and methods for lining bores.

BACKGROUND OF THE INVENTION

In the oil and gas industry, bores or wells are drilled from surface to access subsurface hydrocarbon-bearing formations.

WO 2009/001069 and WO 2009/001073, the disclosures of which are incorporated herein in their entirety, describe arrangements for supporting borehole walls and for applying predetermined stresses to borehole walls. Inflatable chambers are mounted on a base pipe such that inflation of the chambers increases the diameter of the assembly. The chambers may support a sand control element.

WO 2012/066290 and GB 2492193 A, the disclosures of which are incorporated herein in their entirety, describe other arrangements including inflatable chambers to support elements such as sand control screens.

SUMMARY OF THE INVENTION

Sand Screen and Isolation Barrier

According to an aspect of the present invention, there is provided a downhole apparatus including a zonal isolation barrier, the barrier including an inflatable element and having an initial retracted configuration and, following inflation of the inflatable element, an extended configuration.

According to an aspect of the present invention, there is provided a downhole apparatus including a barrier mounted on a sand screen, the sand screen including at least one inflatable element, the barrier and sand screen having an initial retracted configuration and, following inflation of the inflatable element, an extended configuration.

In use, the apparatus may provide zonal isolation when in the extended configuration.

The barrier may be positioned to at least partially cover a portion of the sand screen and thereby prevent fluid flow through the portion.

In use, when the sand screen is extended into contact with a bore wall, the sand screen may be configured to allow fluid flow through a non-covered portion of the sand screen.

The sand screen may include a non-extendable portion and an extendable portion, wherein when in the extended configuration, the sand screen may include a transition area between the non-extendable portion and the extendable portion.

The barrier may be configured to prevent fluid flow through at least a portion of the transition area of the sand screen.

In use, on inflation of the element, the barrier may be pushed out into contact with a bore wall and may serve to isolate a zone on one side of the barrier from a zone on the other side of the barrier.

The barrier may be positioned over a valve controlling flow of production fluid into a base pipe, thereby offering a degree of protection for the valve and assist in balancing flow from a formation, through the bore wall, and into the screen.

The barrier may be configured to prevent fluid from flowing radially and directly into the valve and may allow the fluid to flow axially before reaching the valve.

The inflatable element in this and other aspects of the invention may take any appropriate form and may include one or more of annular, axial or helical elements or chambers. Any appropriate number of inflatable elements may be provided.

The inflatable element in this and other aspects of the invention may be formed of any appropriate material, for example the element may include a metal walled chamber. The material form, shape, thickness and the like may be selected to provide predetermined or predictable behaviour when exposed to inflation pressure or to collapse pressure or forces. The element may be configured to return to the retracted configuration on deflation or may be configured to retain the extended configuration, even if inflation pressure is lost. The inflated element may be configured to retain the extended configuration even when exposed to high external pressures or to high external forces.

The inflation medium in this and any other aspect of the invention take any appropriate form. The inflation medium may include a fluid. The inflation medium may be settable, for example a bi-component material which mixes on entering the element. The inflation medium may be configured to expand under certain conditions.

The inflatable element in this and other aspects of the invention may be configured to retain the retracted configuration until exposed to a predetermined inflation pressure. The inflation pressure may be selected to be higher than a pressure utilized in other downhole operations, such that those operations may be carried out prior to inflation of the element.

The inflatable element in this and other aspects of the invention may be configured to retain the extended configuration until exposed to a predetermined collapse force.

The inflatable element in this and other aspects of the invention may be inflatable by pressure applied internally to tubing on which the element is mounted. Alternatively, the pressure may be applied via control lines. The element may be configured to be inflated using ambient or wellbore fluids, or fluid supplied from a remote location. The inflatable element in this and other aspects of the invention may be provided in combination with one or more inflation valves to control flow of inflation medium into the element. The inflation valve may be a one-way valve, permitting material to pass into the element but preventing material from flowing out of the element. The inflation valve may remain closed until a predetermined pressure differential is applied across the valve, for example the inflation valve may feature a burst disc or the like, or may feature a spring-biased valve closure member. The inflation valve may be configured to open only in response to an appropriate control signal. The control signal may take any appropriate form, and may include a series or sequence of pressure pulses, or an acoustic or electrical signal. Some alternative valve configurations are described in greater detail in relation to other aspects of the invention.

The apparatus may further include a sand screen, the sand screen including an inflatable element, the sand screen having an initial retracted configuration and, following inflation of the inflatable element, an extended configuration. A sand screen element may be provided externally or internally of the inflatable element.

A barrier, such as described herein, may be mounted on one or both ends of the sand screen and share a common inflatable element with the sand screen.

The barrier may include a flexible or elastomeric material.

The barrier may include a sleeve.

The barrier may include a flexible or elastomeric material mounted externally of the inflatable element. The barrier may include a sleeve of flexible material. The barrier may include multiple coaxial sleeves. An inner sleeve may be located externally of the inflatable element and an outer sleeve may be located externally of the inner sleeve. The inner sleeve may have a greater axial extent than the element, and the outer sleeve may have a greater axial extent than the inner sleeve.

A barrier including flexible or elastomeric material may be incorporated into, onto or through the outer sleeve or a shroud.

The barrier may include a swellable material, that is a material adapted to swell on exposure to selected conditions, for example a particular temperature or a particular activator, which may be a fluid, such as oil, water, or a mixture of oil and water. Thus, a degree of extension of the barrier may be provided by inflation of the inflatable elements, and a further degree of extension, through swelling of the swellable material, may also occur. The extension induced by the inflatable elements may be achieved very quickly, while the swelling may occur more slowly. The extension induced by the inflatable elements may be achieved relatively quicker than the extension induced by swelling.

An outer surface of the barrier may be ribbed. For example, the outer surface of the barrier may define multiple circumferential ribs.

According to another aspect of the present invention, there is provided a method of lining a bore including running a zonal isolation barrier into a bore in an initial retracted configuration and then inflating an element to extend the barrier to an extended configuration.

The method may further include running a sand screen into the bore in an initial retracted configuration and then inflating an element to extend the sand screen to an extended configuration.

According to an aspect of the present invention, there is provided a method of lining a bore including mounting a barrier on a sand screen, the sand screen including at least one inflatable element, running the sand screen and barrier into a bore in an initial retracted configuration, and then inflating the element to extend the barrier to an extended configuration.

The barrier may provide zonal isolation when in the extended configuration.

The method may include at least partially covering a portion of the sand screen with the barrier, thereby preventing fluid flow through the portion.

The method may include extending an extendable portion of the sand screen and maintaining a non-extendable portion of the sand screen in a non-extended configuration, and configuring the barrier to prevent fluid flow through at least a transition area of the sand screen between the non-extendable portion and the extendable portion of the sand screen.

The method may include inflating the element to push the barrier out into contact with a bore wall, thereby isolating the zone on one side of the barrier from the zone on the other side of the barrier.

The method may include mounting the barrier over a flow control valve in the base pipe, thereby preventing fluid flow radially through the valve and allowing fluid to flow axially along the screen before reaching the valve.

The method may include configuring the barrier to prevent fluid from flowing radially and directly into the valve and allowing fluid to flow axially before reaching the valve.

The apparatus may include one or more valves for controlling flow of fluid into one or more inflatable elements.

One valve may control flow of fluid into a sand screen inflatable element and a barrier inflatable element. Alternatively, separate valves may be provided for individual elements or for groups of elements.

One or more zonal barriers and one or more sand screens may be combined in a completion. The zonal barriers and sand screens may be provided on separate tubing sections or joints. Alternatively, one or more zonal barriers and one or more sand screens may be provided on a single tubing section or joint, and a zonal barrier and a sandscreen may be extended by inflation of a common inflatable element. Combining a zonal barrier and a sandscreen thus facilitates provision of a large flow area and provides a completion with a relatively consistent inner and outer diameter, with a minimum of diameter changes. This is in contrast to a conventional completion, in which zonal barriers and sandscreens are typically provided on separate tubing sections, which will be coupled together by conventional threaded pin and box connections. To permit the connections to be made up on surface, and for the completion to be held by the slips and safety clamps provided on surface during make-up, a significant proportion of the completion, in addition to the connections themselves, must be formed of solid-walled tubulars having outer surfaces suitable for clamping or gripping. Thus, a significant proportion of the surface area of a conventional completion is impervious and cannot be used, for example, to contribute to an isolation function or to provide a radial fluid flow path between the formation and the interior of the completion.

The barrier may include a flexible or elastomeric material.

The barrier may include a swellable material.

With embodiments of the invention an operator may select to activate or extend a plurality of isolation barriers simultaneously, or may choose to activate or extend isolation barriers individually or in a desired sequence. Similarly, where one or more sandscreens are provided, the sandscreens may be activated or extended simultaneously or individually, and the sandscreens and isolation barriers may be activated or extended simultaneously or individually.

A zonal isolation barrier may be mounted on one or both ends of a sandscreen and may share common inflation elements. In other embodiments one or more zonal isolation barriers may be provided on the same joint as one or more sandscreens but each isolation barrier and sandscreen may be associated with a respective isolation barrier.

Anti-Flood Protection

According to an aspect of the present invention, there is provided method of producing downhole apparatus, the method including forming openings in a sheet, and then at least partially closing the openings, the sheet being adapted to form an element of a tubular member.

The method may include initially forming the openings in the sheet by any one of punching, die casting and machining.

An opening may be completely closed over the length of the opening, or may be closed along a portion of the length of the opening.

The tubular member may be a shroud. The tubular member may be utilized as a shroud for an expandable sandscreen or a sandscreen which is otherwise configurable in an activated or extended configuration, and on activation of the sandscreen incorporating the shroud the at least partially closed openings may open to permit fluid to flow in through the shroud. In a retracted run-in configuration the at least partially closed openings provide a degree of protection for a filter member, such as a weave, located beneath the shroud, for example minimising contact between the solids-laden drilling fluid in the bore and the filter member. The partially closed openings may also provide the sand screen with a relatively smooth outer surface, minimising friction between the shroud and the bore wall as the sand screen is run into the bore. The form of the openings also minimises the risk of the openings hanging up or catching on downhole structures, such as the sharp or rough edges of milled casing windows or multi-lateral junctions.

The outer surface of the tubular member may be polished or otherwise smoothed.

The sheet may be of tubular form when the openings are formed, or may be of planar form when the openings are formed.

The sheet may be of tubular form when the openings are at least partially closed, or may be of planar form when the openings are at least partially closed, and subsequently configured in a tubular form.

The openings may be at least partially closed by reducing the surface area of the sheet. If the sheet is in tubular form, the openings may be at least partially closed by running the sheet through a die.

An aspect of the invention relates to a sandscreen shroud including a wall configured to define inflow openings on activation of the sandscreen.

The shroud may be formed as described above, or may be formed by, for example, part cutting portions of a sheet such that on extension of the sheet the part cut portions open to create inflow openings.

According to an aspect of the present invention, there is provided a tubular member including a wall configured to define inflow openings on activation of an expandable apparatus which is configured to expand the tubular member.

The expandable apparatus may include a sand screen.

The tubular member may be formed in accordance with the method described herein.

The tubular member may be formed by part cutting portions of a sheet such that on extension of the sheet the part cut portions open to create inflow openings.

Weave in Sections

According to an aspect of the present invention, there is provided a sandscreen including a base structure configurable in a retracted configuration and in an extended activated configuration, a first support member mounted on the base structure and an associated first filter section mounted on the first support member, and a second support member mounted on the base structure and an associated second filter section mounted on the second support member, and or on the base structure being reconfigured from the retracted configuration to the activated configuration the first and second support members experiencing relative movement, fluid flowing between an exterior of the sandscreen and the interior of the base member being required to flow through at least one of the first and second filter sections.

Edges of the first and second support members may overlap, or may be spaced apart.

The support members may be apertured to permit fluid to flow through the filter sections and then through the support members.

The support members may be dimpled to permit fluid to flow through or under the support members.

Edges of the first and second filter sections may overlap, or may be spaced apart. At least one edge of the first and second filter sections may be free of at least one of apertures and dimples to permit a seal to be formed between the edge and an underlying element.

The support members may be substantially rigid such that the form of the members is retained as the base member is reconfigured.

The support members and the associated filter sections may extend axially of the sandscreen.

The support members may have an arcuate form.

The base member may include a base pipe.

The base structure may include a base pipe and at least one inflatable element mounted on the base pipe.

An edge of at least one support member may be fixed and sealed to a respective inflatable element.

Another edge of at least one support member may sit over an adjacent inflatable element and may be free to move across the surface of the element as the sandscreen is activated.

The free edge of at least one support member may be configured to remain substantially in sealing contact with the underlying inflatable element when, in use, the free edge is moved across the surface of the element.

According to another aspect of the present invention, there is provided a sandscreen assembly method including mounting a first filter section on a first support member, mounting a second filter section on a second support member, mounting the first support member on a base structure, and mounting the second support member on the base structure. The base structure is reconfigured from a retracted configuration to an extended configuration, the first and second support members experience relative movement and fluid flowing between an exterior of the sandscreen and the interior of the base structure is required to flow through the first or second filter section.

The base structure may include a base pipe and at least one inflatable element mounted on the base pipe.

An edge of at least one support member may be fixed and sealed to a respective inflatable element.

Another edge of at least one support member may sit over an adjacent inflatable element and may be free to move across the surface of the element as the sandscreen is activated.

The free edge of at least one support member may be configured to remain substantially in sealing contact with the underlying inflatable element when, in use, the free edge is moved across the surface of the element.

The method may include providing dimples in the support members to permit fluid to flow through or under the support members.

The method may include fixing and sealing at least one edge of a support member to a respective inflatable element.

The method may include positioning the other edge of the at least one support member over an adjacent inflatable element and configuring the filter sections to be freely movable across the surface of the element upon activation or extension of the sandscreen.

The method may include configuring the free edge of the at least one support member to remain substantially in sealing contact with the underlying inflatable element when, in use, the free edge is moved across the surface of the element.

The method may include providing the first filter section and first support member as a unitary component and mounting the component on the base structure.

The method may include providing the second filter section and second support member as a unitary component and mounting the component on the base structure.

The mounting of the filter sections on the support members tends to facilitate manufacture of the sand screen. In conventional sandscreen manufacture, a single length of weave is wrapped around the screen body and must then be retained on the body to permit a protective shroud to be located over the weave. For an expandable sandscreen the edges of the weave must overlap, to accommodate the subsequent increase in diameter. Thus, handling, manipulating and securing a conventional format weave in such an operation is difficult.

Furthermore, when the diameter of a sandscreen having a conventional wrapped weave is increased, the overlapping edges of the weave must slide relative to one another, and the weave must also slide relative to adjacent elements of the sandscreen. This sliding generates circumferential frictional forces on the weave and on the adjacent sandscreen elements, which may be described as a capstan effect. This effect may increase the forces required to activate the sandscreen and may result in damage to the weave and adjacent sandscreen elements. For example, in a sandscreen featuring inflatable elements or chambers, forces transferred to the chambers by the weave may tend to displace the chambers. However, embodiments of the present invention avoid or minimise these difficulties by mounting weave sections on respective support members.

Stackable Chambers

According to an aspect of the present invention, there is provided downhole apparatus including a base pipe and a first inflatable element mounted on the base pipe, the pipe and element having portions configured to engage intermediate the ends of the element and restrict relative movement therebetween.

The portions may serve to retain the positioning of the element relative to the base pipe as the element is inflated. For example, the element may extend axially of the base pipe and it may be desired to substantially retain this relationship, for example the portions may be configured to restrict circumferential movement of the element on the base pipe.

As an element is inflated there may be a variety of forces acting on the element which would otherwise tend to move the element relative to the pipe, such as the capstan effect as described above. For example, the element may support an external member, such as a sealing element, a shroud, a sand screen element or a bore-lining sleeve. Further, the apparatus may be located within an inclined bore and may initially lie on the low side of the bore, or the bore may have an irregular or otherwise non-circular wall. As the element is inflated the external dimension of the element will increase and the element will tend to move and deform in a manner which encounters least resistance. If left unchecked or unrestrained this tendency may result in the inflated element assuming a form which has a negative effect on the function or purpose of the apparatus. Embodiments of the invention seek to maintain the relationship between the base pipe and the element and thus maintain the utility of the apparatus.

The portions may be configured to maintain the inflatable element in an initial position relative to the base pipe upon inflation of the element.

The element may be metal-walled.

As the element is inflated the element wall will deform relative to the base pipe, which may, for example, be a rigid metal structure. The engaging portions may include cooperating male and female portions, which portions may be oriented substantially radially relative to the base pipe axis. For example, a radially extending spigot may be provided on an inner surface of the element for engaging a corresponding recess on an outer surface of the base pipe.

The engaging portions may engage while the element is in a retracted configuration, or the portions may only engage as the element is inflated or activated.

One or both ends of the element may be retained relative to the base pipe.

A plurality of inflatable elements may be provided.

A second inflatable element may be mounted on the first inflatable element.

The first inflatable element may include multiple cells or segments.

According to a further aspect of the present invention, there is provided downhole apparatus including a base pipe and a first inflatable element mounted on the base pipe, at least one of the pipe and element having portions configured to engage the pipe and the element together and restrict relative movement therebetween.

According to a still further aspect of the present invention, there is provided a downhole operation including inflating an element mounted on a base pipe and reforming a portion of the element to engage the base pipe and restrict relative movement therebetween.

The base pipe may include a channel configured to receive a portion of the chamber wall. The channel may extend axially of the base pipe. Upon inflation of the element, the portion may be deformed to at least partially engage the channel, thereby restricting relative movement between the element and the base pipe.

The element may include a first inflatable element.

A second inflatable element may be mounted on the first inflatable element.

The first inflatable element may include multiple cells or segments.

The various aspects and arrangements described above facilitate provision of apparatus which is capable of providing a high degree of expansion, while retaining a degree of control or stability over the expanded form of the apparatus. For example, by providing stacks of multiple elements or multi-cell elements it is possible to provide for expansion in excess of 35%, and in excess of 40%. This permits the apparatus to be run in through existing tubing or existing restrictions and then expanded beyond the restrictions. The high degree of expansion available also facilitates use of apparatus of a relatively small initial diameter, and such apparatus may be more convenient to transport and handle and may be more readily advanced into a bore, particularly an extended reach or highly deviated bore. The provision of the multiple elements will also likely lead to provision of relatively large open areas between adjacent elements, facilitating radial and axial fluid flow. According to another aspect of the present invention, there is provided downhole apparatus including a base member and a plurality of inflatable elements mounted externally of the base member, at least a first element being mounted on a second element and being spaced from the base member by the second element.

In other embodiments further elements may be provided, for example a third element may be mounted on the second element.

Further elements may be mounted on the first or second elements.

The first and second elements may be located or aligned along a radius of the base member.

The first and second elements may thus be stacked. Multiple stacks of elements may be provided and the stacks may be circumferentially spaced. The stacks may provide support for other members or elements, such as screens, sand control filters, seals and shrouds. The provision of stacks of elements facilitates provision of high degrees of expansion, for example in excess of 35 or 40%.

The first and second elements may include discrete chambers having respective walls. Alternatively, the first and second elements may share a common wall, for example the first element may include a first chamber and the second element may be formed by securing edges of a strip of material along a wall of the first chamber.

According to a further aspect of the present invention, there is provided downhole apparatus including a base member and an inflatable element mounted thereon, the element including an inner inflatable cell located within an outer inflatable cell.

The combination of the inner and outer cell may combine to provide an inflated element with enhanced qualities, for example elevated collapse resistance, the inner cell may support or strengthen the outer cell.

The cells may be separately inflatable, or may be configured to be inflated together.

The cells may take any appropriate form. For example, the cells may be of generally similar form, or the inner cell may be inflatable to assume a circular cross section while the outer cell is inflatable to assume an oval cross section.

The cells may be configured such that an outer surface of the inflated inner cell contacts an inner surface of the inflated outer cell. The contact may be over a relatively small area, or may be over an extended area.

Base Pipe with Grooves/Spacers

According to an aspect of the present invention, there is provided downhole apparatus including a base pipe, at least one inflatable element mounted externally on the base pipe and a spacer located between the base pipe and the element.

A plurality of inflatable elements may be provided.

The inflatable element may extend axially along the base pipe.

The spacer may extend axially along the base pipe.

The spacer may include a control line or conduit.

The spacer may serve to radially separate the base pipe and the element. The cross-section of the spacer may be relatively smaller than the cross-section of the element. The relatively smaller cross-section of the spacer may provide an increased flow area externally of the base pipe, for example, compared with providing the inflatable element directly on the outer surface of the base pipe.

The spacer may serve to locate the element relative to the base pipe.

The spacer may include a tube or pipe.

A plurality of spacers may be provided between the base pipe and a single element.

A weave may be mounted externally of the element.

Upon inflation of the element, a larger flow area may be provided between the base pipe and the weave.

The spacer may extend into a corresponding recess in the adjacent element wall.

According to another aspect of the present invention, there is provided downhole apparatus including a base pipe and at least one inflatable element mounted externally on the base pipe, the base pipe having a scalloped outer surface.

These two aspects of the invention may be combined if desired, to provide a greater free volume between the base pipe and chamber. For example, the free volume provided may be greater compared with providing the inflatable element directly on the outer surface of the base pipe.

Back-Up Mesh

According to an aspect of the invention, there is provided an inflow apparatus including a base pipe and a screen located around the base pipe, the base pipe defining an inflow port and a filter associated with the inflow port, whereby fluid may flow from a formation, through the screen, through the filter and the inflow port, and into the base pipe.

According to another aspect of the present invention, there is provided a sand control method including locating a sand screen in a bore and flowing fluid from a surrounding formation, through a screen mounted around a base pipe, through a filter associated with an inflow port, and into the base pipe.

The filter may take any appropriate form and may be coarser than the sand screen.

In the event that the screen is compromised, the filter may prevent or restrict sand inflow into the base pipe. The presence of the filter may also protect any valves or the like associated with the inflow port, facilitating subsequent closure of the port.

The filter may be associated with a plurality of inflow ports.

The filter may be located in recess in an outer face of the base pipe.

The filter may have an annular form.

Multi-Position Valve

According to another aspect of the present invention, there is provided downhole apparatus including a base pipe, an inflatable element mounted on the base pipe, and an inflation valve for controlling flow of inflation fluid between the tubular bore and the element, the inflation valve being initially closed to isolate the element from the tubular bore.

The initial closing of the valve ensures that the element is not inflated prematurely or accidentally.

The inflation valve may be initially locked closed, and may be unlocked by exposure to a first pressure. The valve may be configured such that the first pressure is higher than a second pressure for inflation of the element.

The inflation valve may be initially locked closed by a releasable retainer, such as a shear pin or the like.

The inflation valve may include a valve member, which may include a valve sleeve.

The inflation valve may be configured to be initially locked in a closed configuration and then unlocked but still maintained in the closed configuration.

The inflation valve may be biased in a first direction, for example by a spring.

The inflation valve may be configured to be urged towards an open configuration by actuating pressure.

The apparatus may include an actuating piston coupled to a valve member via a control member, which may be in the form of a sleeve. Movement of the sleeve may be controlled by an indexing profile. The control member may be configured to control or limit the range of movement of the valve member. In a first configuration the control member may limit the movement of the valve member to prevent the valve from opening and in a second configuration the control member may permit sufficient movement of the valve member to open the valve. Thus in the first configuration the piston may be subject to actuating pressures higher than would be desirable for inflating the element.

The apparatus may include a valve configuration sequence control mechanism configured to restrict movement of the valve from a closed configuration to an open configuration and then to a closed configuration.

The valve configuration sequence control mechanism may include an indexing profile, for example a slot or track and a pin follower. The profile may have a stepped base or floor and cooperate with a sprung pin follower, ensuring the follower may only progress in one direction along the profile.

The apparatus may be provided in combination with a sandscreen in which the inflatable element is utilized to activate a bore wall support or other member.

According to an aspect of the present invention, there is provided a flow control method, including providing an inflation valve for controlling flow of fluid into an inflatable element mounted on a base pipe, initially locking the inflation valve in a closed configuration to prevent fluid flow to the inflatable element, applying a first fluid pressure to unlock the inflation valve, the inflation valve remaining in the closed configuration, bleeding off fluid pressure to selectively place the inflation valve in an open configuration in which the inflatable element is in fluid communication with the interior of the base pipe, and increasing fluid pressure to inflate or activate the inflatable element.

The method may include providing the inflation valve in the form of a valve member and controlling the valve member with a control member.

The method may include controlling movement of the valve member by the interaction of the control member with an indexing profile.

The method may include limiting the movement of the valve member with the control member to prevent the inflation valve from opening.

The method may include permitting movement of the valve member with the control member to open the inflation valve.

The method may include restricting movement of the valve member from the closed configuration to the open configuration and then to a further closed configuration.

The method may include maintaining the valve member in the open configuration by preventing movement of the valve member.

The method may include trapping inflation pressure in the inflatable element.

The method may include bleeding off fluid pressure to permit movement of the valve member towards a further closed configuration in which the inflatable element is no longer in fluid communication with the interior of the base pipe.

The method may include locking the valve member in the further closed configuration.

According to another aspect of the present invention, there is provided a downhole apparatus including a tubular, a flow port in a wall of the tubular, and a flow port valve biased in a first direction towards an open configuration, the flow port valve being initially locked closed and being configured to be unlocked by a fluid pressure force acting on the valve in a second direction.

The apparatus may be provided in conjunction with a completion element, a sandscreen or the like.

The apparatus may be provided in combination with an inflation element valve arrangement as described above. The fluid pressure required to unlock the flow port valve may be higher than the pressure required to unlock the inflation valve, allowing the inflation valve to be opened first, followed by the flow port valve, which may incorporate an inflow control device (ICD) or the like.

The flow port valve may include a valve member, which valve member may be in the form of a sleeve. The sleeve may be located internally of the wall defining the flow ports. The sleeve may be initially fixed relative to the wall by releasable retainers, such as shear pins.

The sleeve may form part of a piston arrangement. On exposure to an elevated internal release pressure, the piston arrangement may generate a force sufficient to, for example, shear locking pins, to permit a degree of movement between the sleeve and the wall. Once pressure is bled off, a compression spring or other biasing arrangement may urge the sleeve back in the opposite direction to align a sleeve port with the flow port. Production fluid may thus now flow into the tubular.

At least a portion of the sleeve may be adapted to be shifted mechanically and may be provided with a profile to facilitate engagement with a mechanical shifting tool. Thus, the sleeve portion may be shifted to align an alternative sleeve port with the flow port. The alternative flow port may incorporate an inflow control device. Alternatively the alternative flow port may be blanked off, or the sleeve portion may include a section without ports, such that movement of the sleeve portion closes the flow port. The sleeve portion may be initially fixed by a releasable retainer. In certain embodiments the sleeve portion may be further shifted to reinstate flow, for example by realigning the first sleeve port with the flow port.

According to an aspect of the present invention, there is provided a flow control method, including providing a flow port valve for controlling fluid flow through a flow port in a wall of a tubular, initially locking the flow port valve in a closed configuration, applying a first fluid pressure to unlock the flow port valve, the flow port valve remaining in the closed configuration, and bleeding off fluid pressure to open the flow port valve.

Opening the flow port valve may provide an inner tubular in fluid communication with a surrounding formation.

The flow port valve may include a valve member.

The valve member may include a sleeve.

The valve member may be located internally of the wall defining the flow port.

The method may include applying the first fluid pressure to apply a force on the valve member, the force acting in a first direction.

The method may include biasing the valve member such that bleeding pressure off allows the valve member to move in a second, opposite direction to align a valve member port with the flow port.

The flow port, once aligned with the valve member port, may permit fluid flow through the flow port and valve member port.

The method may include allowing production fluid to flow from a surrounding formation through the flow port and valve member port.

The method may include allowing a fluid to flow into a surrounding formation through the flow port and valve member port.

The method may include adapting the valve member to be movable to open or close the flow port.

The method may include moving the valve member by engaging a mechanical shifting tool with a profile on the valve member.

The method may include further moving the valve member to reinstate flow after the flow port has been closed.

Bore Liner

According to an aspect of the present invention, there is provided apparatus for lining a bore including: a base pipe, an inflatable element mounted on the base pipe, a first tubular member mounted over the inflatable element wherein activation of the inflatable element causes the first tubular member to extend to describe a larger diameter, and then retain the larger diameter on subsequent deactivation and removal of the inflatable element.

The first tubular member may be extendable.

The first tubular member may include a filter element.

The apparatus may include a bridging member mounted on the inflatable element and for supporting the first tubular member.

The apparatus may include a second tubular member. The second tubular member may be mounted on the first tubular member. The second tubular member may be extendable.

The apparatus may include a filter element, such as a weave or the like. The filter element may be supported by an extendable tubular member, and may be sandwiched between two coaxial extendable tubular members.

According to another aspect of the present invention, there is provided a method of lining a bore, the method including inflating an element mounted on a base pipe and increasing the diameter described by a first tubular member mounted over the inflatable element, deflating the inflated element to separate the element from the extended tubular member and removing the base pipe and the inflatable element from the extended tubular member.

The first tubular member may be extendable.

The first tubular member may include a filter element.

The method may include mounting a second extendable tubular member on the first extendable tubular member.

These aspects of the invention may be useful in supporting a bore wall or formation face. The invention may also be useful in stabilising the bore wall and prevent or minimise material sloughing off the bore wall.

Staged Cementation

According to another aspect of the invention, there is provided downhole apparatus including a tubular body, a flow port in the body, at least one inflatable element on the exterior of the body, and an inflation valve controlling flow of material into the inflatable element, wherein the flow port permits material to flow from the body into an annulus surrounding the body and inflation of the element extends the element into the annulus.

The flow port may be provided above or below the inflation valve.

The flow port may be provided in combination with a flow valve for controlling flow of material through the flow port. The flow valve may initially close the flow port. The flow valve may be a one-way valve, such as a float valve. The flow valve may be operatively associated with the inflation valve, and may be configured to operate in conjunction with the inflation valve.

The inflation valve may initially be closed.

The inflation valve may include a sleeve mounted within the body.

The inflatable element may include an annular, helical or axial chamber.

Any appropriate number of inflatable elements may be provided.

The inflatable element may include a metal wall, and may include an elastomeric or flexible material on the exterior of the wall.

The inflation element may be configured to retain an extended configuration. This may be achieved by, for example, retaining the inflation medium within the element, or by forming the element such that the structure of the element retains the extended configuration.

The inflation element may be located above or below the flow port.

Another aspect of the invention provides downhole apparatus including a tubular body, at least one inflatable element on the exterior of the body and an inflation valve controlling flow of material into the inflatable element, the inflation valve being configured to open in response to a predetermined fluid pressure.

The predetermined pressure may coincide with a test pressure applied to the body, for example a casing integrity test pressure. Thus, the element may be inflated when a section of casing incorporating the apparatus is subject to pressure testing, which pressure testing may follow a cementing operation.

According to a further aspect of the invention, there is provided a tubular sealing or cementing method, the method including passing a settable material from a tubular interior into an annulus surrounding the tubular, opening an inflating valve and inflating an element on the exterior of the tubular to extend into the annulus.

The settable material may be cement.

The method may include translating a device through the tubular to open the inflation valve. The device may be a dart, wiper plug or the like, and may be translated through the tubular above or below a volume of settable material, or separately of a volume of settable material.

The method may include opening a flow valve controlling flow of the settable material from the tubular interior to the annulus.

The method may include translating a device through the tubular to open the flow valve.

The inflated element may extend across the annulus from the tubular to engage a surrounding bore wall, which wall may be defined by casing or by an unlined borehole wall. The element may extend through the settable material. The inflated element may assist in sealing the annulus, particularly against movement of fluid axially along the annulus.

The inflated element may be configured to at least partially seal the annulus.

The inflatable element may be provided at any suitable axial location on the tubular. For example, the element may be located towards the lower or distal end of the tubular, where the inflated element will facilitate retention of the column of settable material in the annulus. Alternatively, the inflatable element may be provided spaced from the lower or distal end, to provide a barrier in a staged cementation operation.

These aspects of the invention may be useful in cementation operations, with the inflatable element being used to provide a degree of isolation of or between cemented sections. In particular, embodiments of the invention may be utilized in providing support for an upper cementation stage and isolating a lower cementation stage from the hydrostatic head created by the upper stage.

The skilled person will realise that individual features of the various aspects of the invention as described above, as described in the following detailed description, and as set out in any of the appended claims, may be combined, individually or in combination, with features of other aspects and embodiments of the invention, as appropriate.

BRIEF DESCRIPTION OF THE DRAWINGS

These and other aspects of the invention will now be described, by way of example, with reference to the accompanying drawings, in which:

FIGS. 23*aa* to 23*ee* are schematic illustrations of the relationship between the indexing profile and the follower pin of the apparatus of FIGS. 23*a* to 23*e;*

DETAILED DESCRIPTION OF THE DRAWINGS

Figure 1:
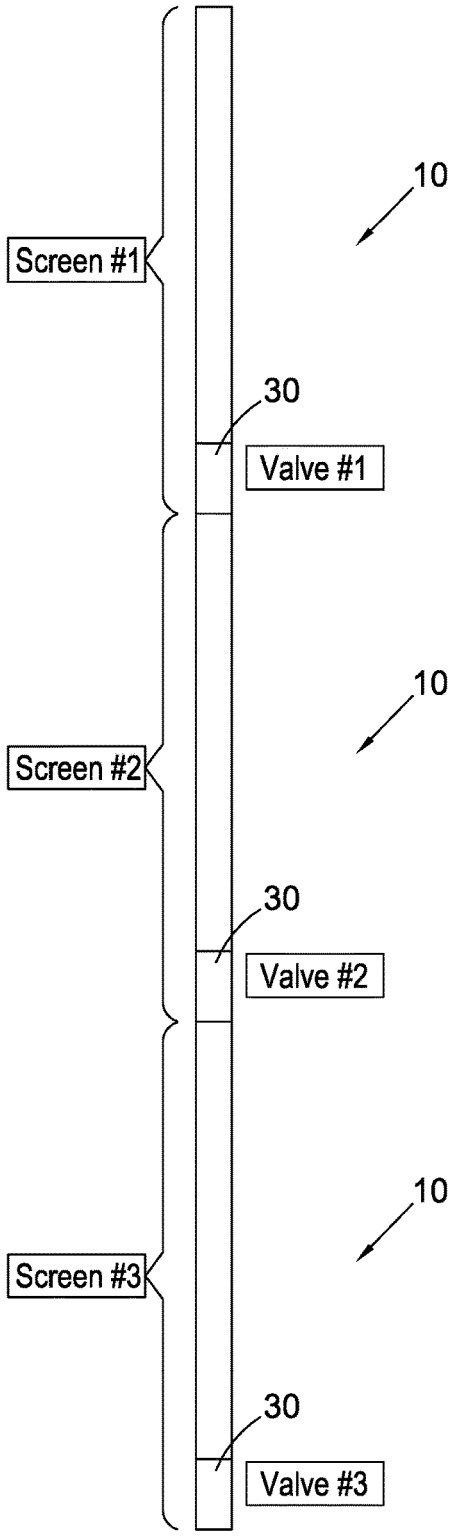
FIG. 1 is a schematic illustration of part of a completion including three sand screens.

Reference is first made to FIG. 1 of the drawings, which is a schematic illustration of part of a well bore completion including three sand screens joints 10, in accordance with embodiments of the present invention. Features of such screens 10 may be utilized in combination with various aspects and embodiments of the present invention, as will be described. Of course, the completion will include many other elements and devices not shown in the drawing, such as a shoe on the leading end of the completion, packers for zonal isolation, hangers, valves and the like, and some of these may form further aspects and embodiments of the invention.

The screens 10 are run into the hole as part of a completion string and in a retracted or smaller diameter configuration and subsequently activated to assume a larger diameter configuration, in which the outer surface of the screens approaches and preferably engages the bore wall, whether this be formed by casing, liner, or an unlined bore section.

Figure 2:
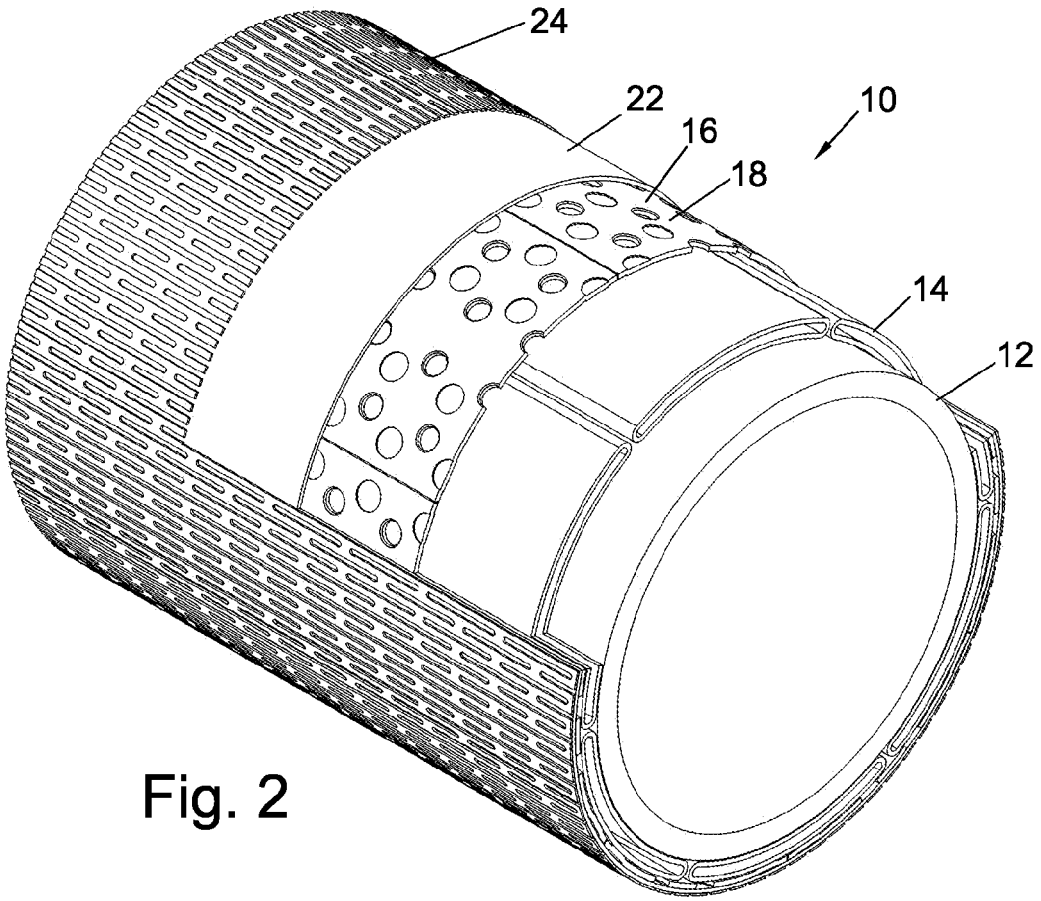
FIG. 2 is a part cut-away view of part of one of the screens of FIG. 1.
Figure 3:
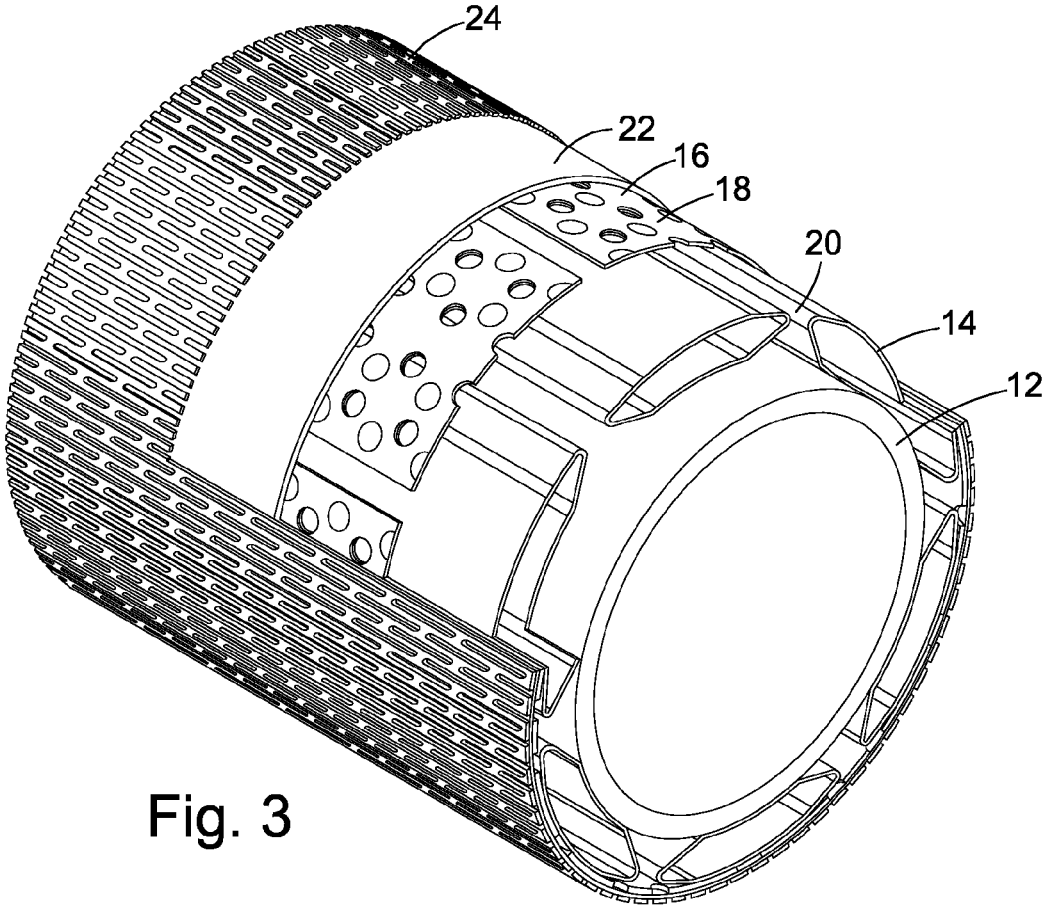
FIG. 3 corresponds to FIG. 2 but shows the screen in an activated configuration.

FIG. 2 of the drawings illustrates a part cutaway view of part of one of the screens of FIG. 1, showing the screen 10 in an initial retracted configuration. The screen 10 includes a rigid metal base pipe 12 providing mounting for six activation elements or chambers 14 which extend axially along the outer surface of the base pipe 12. The chambers 14 have metal walls and are arranged side-by-side around the base pipe 12 and may be inflated or deformed by filling the chambers 14 with high pressure fluid such that the chambers 14 assume an activated configuration, as illustrated in FIG. 3 of the drawings.

A drainage/support layer 16 is located externally of the chambers 14, the layer 16 including six support strips 18 of aperture curved steel sheet. Like the chambers 14, the strips 18 are arranged side-by-side and extend axially along the screen 10, but are circumferentially offset relative to the chambers 14, as illustrated in the drawings, such that when the chambers 14 are extended, the strips 18 bridge the gaps 20 formed between the chambers 14.

The drainage layer 16 supports a filter media in the form of a weave 22. The weave 22 may include a single length of material wrapped around the drainage layer with the longitudinal edges overlapping, or may include two or more lengths or strips of material. A protective cylindrical shroud 24 is provided over the weave 22.

The flow of inflation fluid into the chambers 14 is controlled by appropriate valve arrangements 30 (FIG. 1). A valve 30 is associated with each joint 10. The flow of production fluid from the surrounding formation may also be controlled by the valve 30.

Figure 4A:
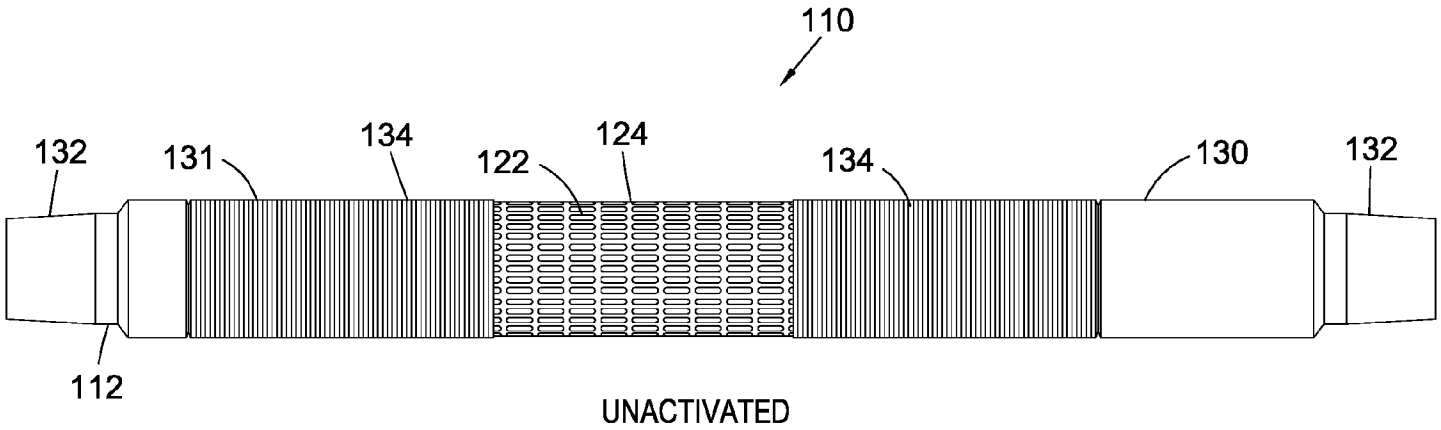
FIGS. 4*a* and 4*b* show a sandscreen joint in accordance with an embodiment of the present invention.
Figure 4B:
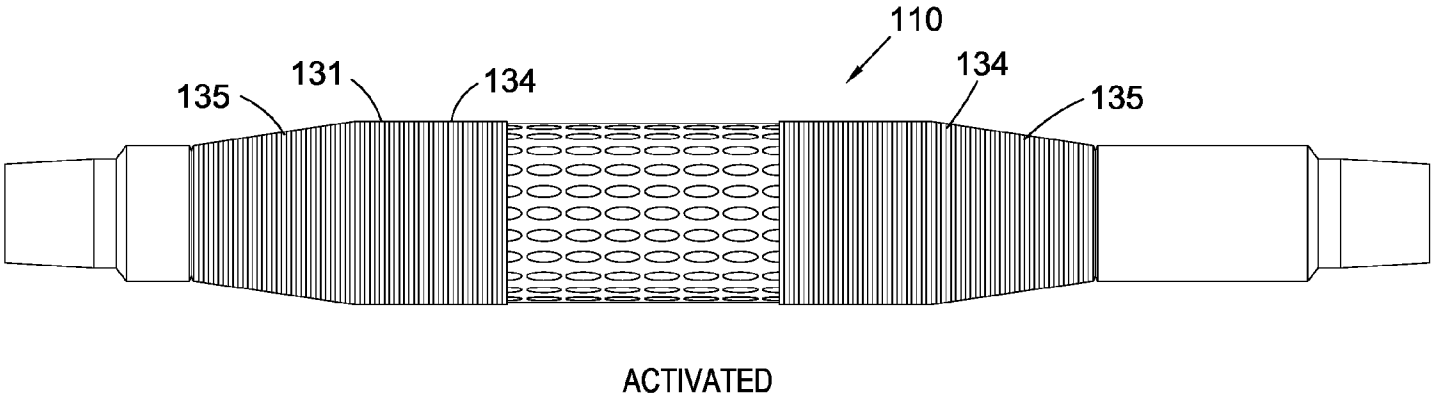

Reference is now also made to FIGS. 4*a* and 4*b*, which illustrate a sandscreen joint 110 in accordance with an embodiment of the present invention. It should be noted that the central section of the joint 110 as illustrated in FIGS. 4*a* and 4*b* is shown substantially shortened; the central section, over which the filter media 122 is exposed (through the screen shroud 124) represents more than 75% of the total length of the joint 110. FIG. 4*a* shows the screen 110 in an un-activated or retracted configuration (corresponding to the configuration illustrated in FIG. 2), whereas FIG. 4*b* shows the screen in an activated or extended configuration, (corresponding to FIG. 3).

The sandscreen joint 110 is provided with threaded pin and box-type connections 132 at each end. One end of the joint 110 also includes the valve arrangement 130 for controlling the inflation of the activating elements provided in the joint, and also for controlling the flow of fluid from the surrounding formation, through the screen and into the base pipe 112. The valve arrangement may be similar to that described in GB2492193A, or may be one of the other valve arrangements as described herein. The general arrangement of activating elements, drainage layer, weave and shroud may be substantially as described above with reference to FIGS. 2 and 3, or alternatively or in addition may be in accordance with one of the various alternative arrangements described herein.

In addition to allowing fluid to flow into the bore and then through the various elements of the sandscreen and into the base pipe 112, the sandscreen joint is also capable of providing zonal isolation. In particular, the ends of the portion of the joint 110 that are capable of extension on activation of the sandscreen 110, including the transition area 135, are coated with an elastomer sleeve 134. On activation of the sandscreen 110, the sleeve 134 is pushed out into contact with the bore wall and serves to isolate the zone on one side of the activated sleeve 134 from the zone on the other side of the sleeve 134. Thus, the provision of the sleeve 134 on the activated sandscreen prevents production fluid from flowing axially along the bore between the bore wall and sandscreen, and indeed axially through the portion of the sandscreen between the base pipe and the bore wall. This serves to protect the weave at the transition area 135, preventing axial flow through the transition area, which it has been found is the area where the weave tends to be weakest, and where the weave might otherwise be vulnerable to erosion damage.

Flow into the sandscreen joint 110 from the surrounding formation may thus only take place through the fully extended portion of the screen, between the sleeves 134, where the sandscreen typically contacts and supports the bore wall. Flow through the weave will thus tend to be substantially radial, allowing the weave to operate at maximum efficiency.

Where similar sandscreen joints 110 are coupled end-to-end, the sleeves 134 create isolated zones or annuli between the bore wall and the sections of the sandscreens which are not extended into contact with the bore wall. Thus, production fluid will not tend to flow from the surrounding formation and into these zones, minimising the risk of flow-induced collapse of the unsupported surrounding bore wall.

The sleeve 134 may be positioned over the valve which controls flow of production fluid into the base pipe and thus may offer a degree of protection for the valve and assist in balancing flow from the formation, through the bore wall, and into the screen. The sleeve 134 prevents fluid from flowing radially and directly through the weave and into the valve. The fluid must flow axially along the screen before reaching the valve.

To enhance the sealing capabilities of the elastomer sleeve 134, the outer surface of the sleeve defines circumferentially extending ridges or ribs 131. Surprisingly, it has been found that this improves the sealing effect achieved by the activated sleeves 134. It is believed that this is due to a coupling effect between adjacent ribs.

Figure 5:
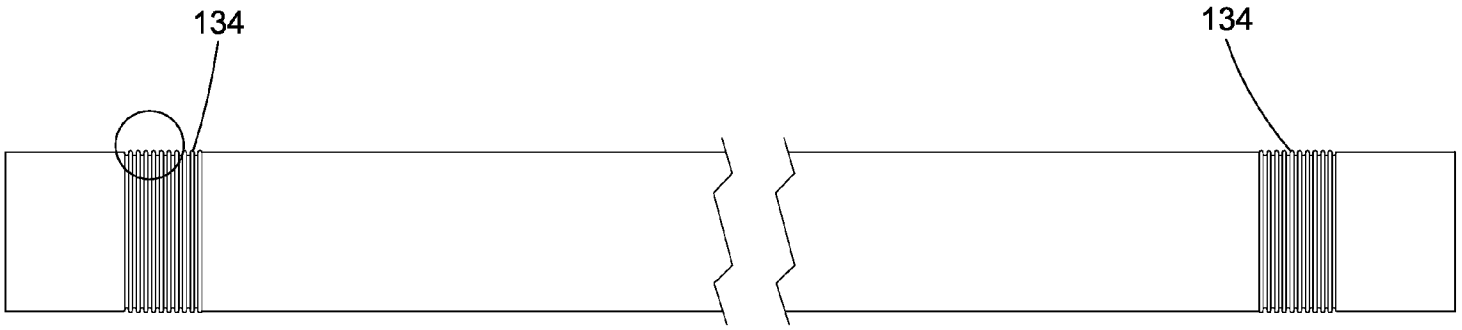
FIGS. 5 and 6 show details of the joint of FIGS. 4*a* to 4*b;*
Figure 6:
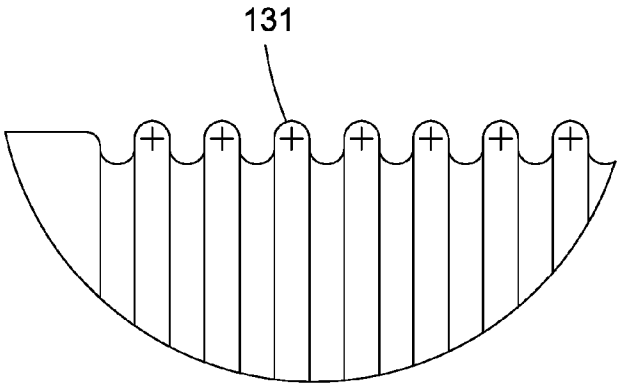

Details of the sleeve 134 are shown in FIGS. 5 and 6 of the drawings, the detail of FIG. 6 illustrates the rounded form of the ribs 131. In this particular example, the ribs 131 and the associated troughs have been machined with a 5 mm radius in a sleeve 134 that is 10 mm thick.

In use, a sandscreen joint 110 provided with elastomeric sleeves 134 may be provided in combination with screens which do not feature any sealing arrangement, the sandscreen joints 110 with sleeve 134 only being provided on completion where zonal isolation is desired.

Figure 7A:
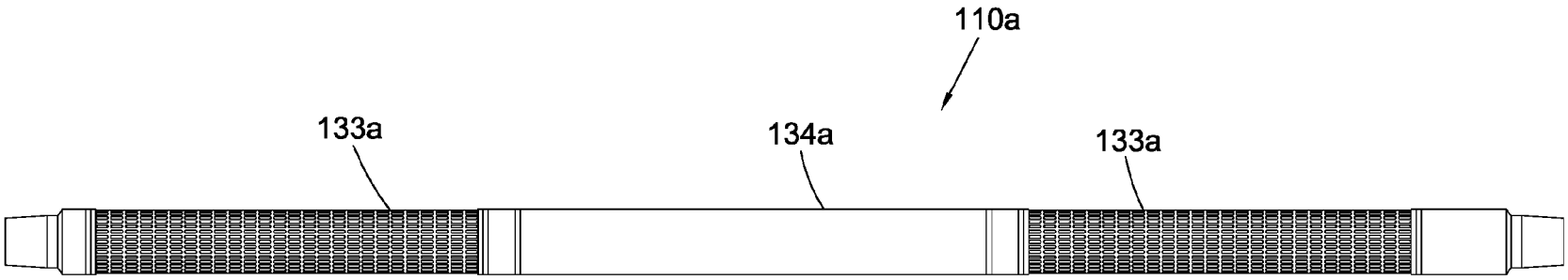
FIGS. 7*a*, 7*b* and 7*c*, and 8*a* and 8*b* show combined sandscreen and zonal isolator joints in accordance with embodiments of the present invention.
Figure 7B:
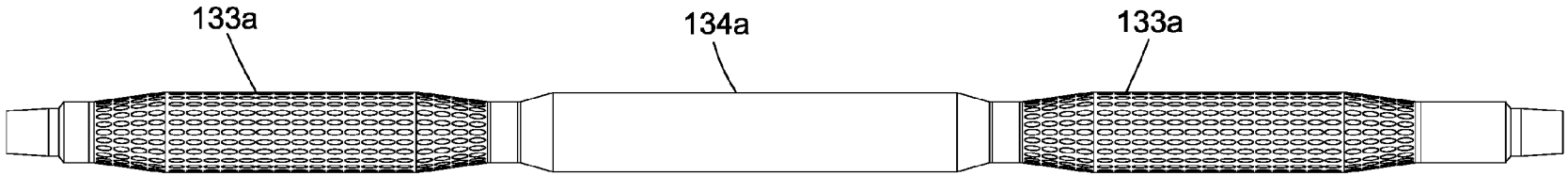

In the sandscreen joint 110 as described above zonal isolation is provided by mounting the elastomer sleeves 134 on the ends of the permeable screen section. However, if desired, the screens and zonal isolation may be provided separately within a joint, or in separable joint sections, as illustrated in FIGS. 7 and 8. In FIGS. 7*a* and 7*b*, the illustrated sandscreen joint 110*a* has two screen sections 133*a* provided towards the end of the joint 110*a*, with a stand-alone zonal isolation barrier section 134*a* being provided in a central portion of the joint 110*a*. The screen sections 133*a* and the barrier section 134*a* may be activated under the control of a common inflation valve, or each section may be provided with a dedicated valve.

Figure 7C:
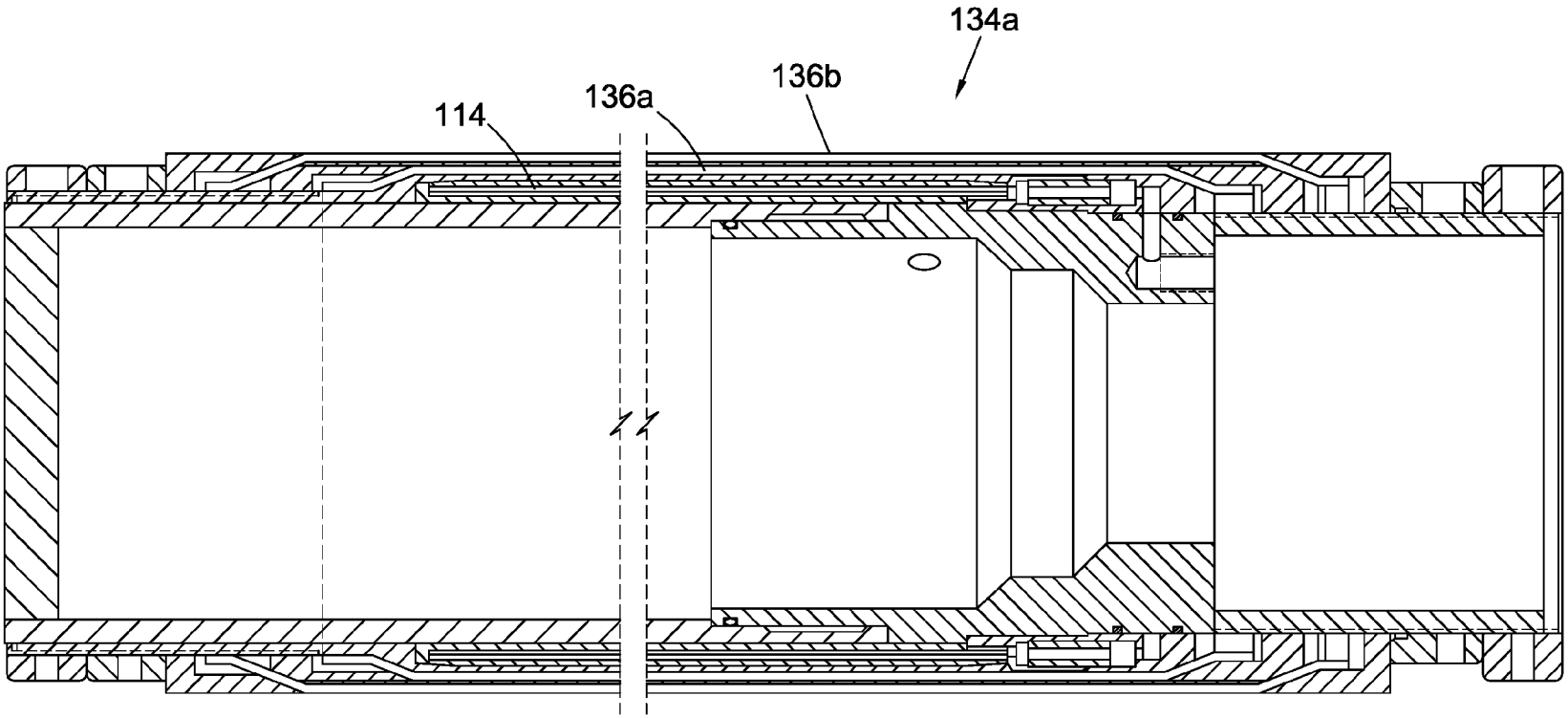

FIG. 7*c* of the drawings illustrates a sectional view of the barrier section 134*a* which, in addition to the inflatable elements 114, features an inner and an outer elastomer sleeve 136*a*, 136*b*, which arrangement has been found to provide a more robust barrier than a single layer sleeve.

Figure 8A:
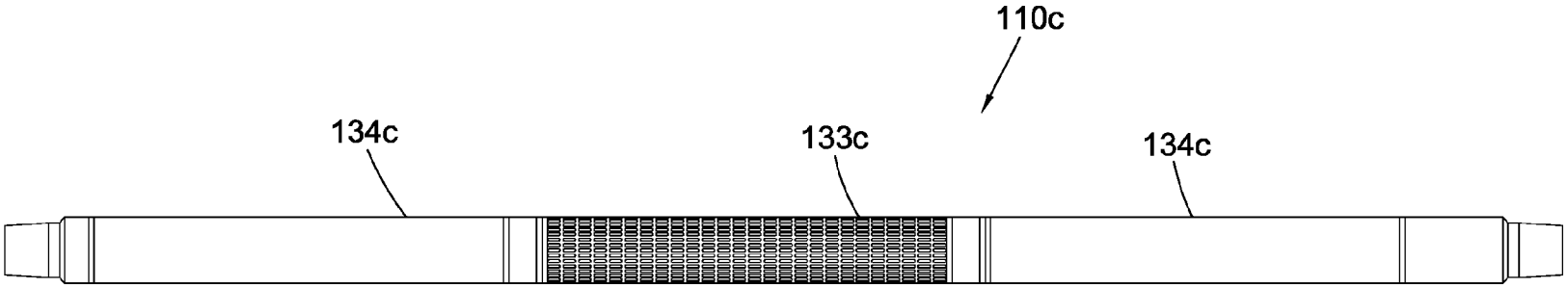
Figure 8B:
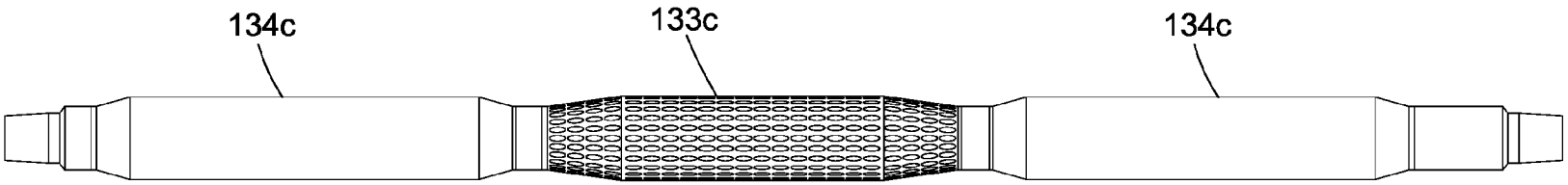

In FIGS. 8*a* and 8*b*, a joint 110*c* including a single base pipe includes a single central screen section 133*c* and two separate zonal isolation barrier sections 134*c* towards the end of the joint 110*c*, activation of both the screen section and the barrier sections being controlled by a common inflation valve.

The screen joints may be combined as desired in order to match the geology or profile of a particular well. The ability to combine a screen and a zonal isolation barrier in a single joint facilitates making up the completion string and also facilitates maximisation of inflow area when compared with conventional completion arrangements.

Figure 9A:
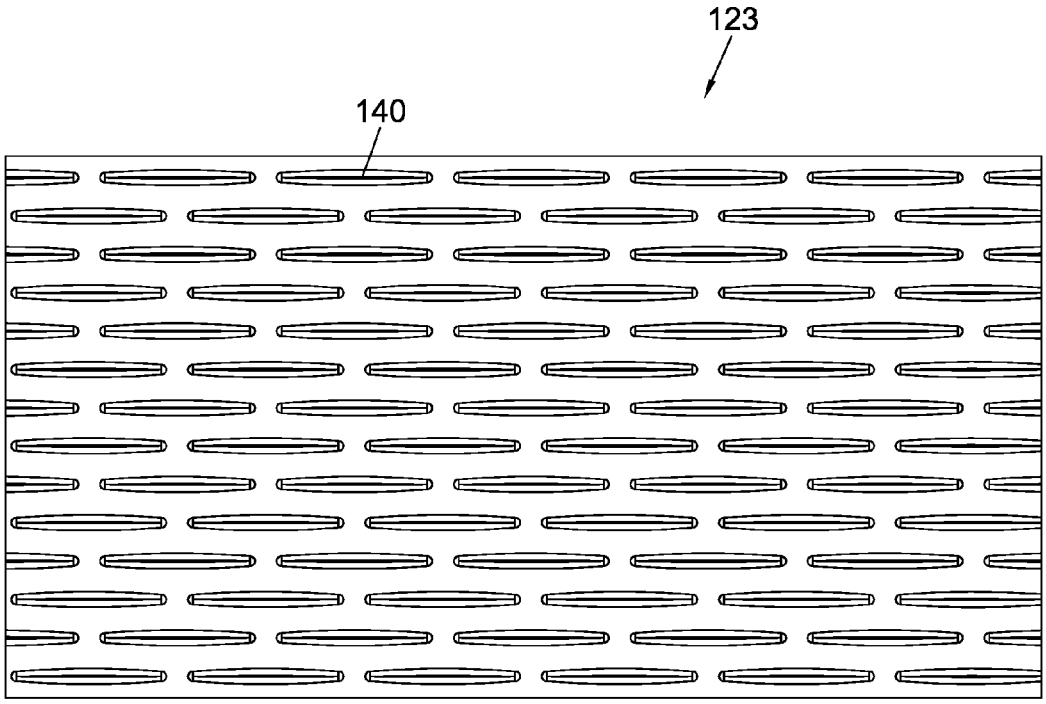
FIGS. 9*a* and 9*b* show a plan view of a sheet defining a plurality of openings, for use in forming a shroud, in accordance with an embodiment of the present invention.
Figure 9B:
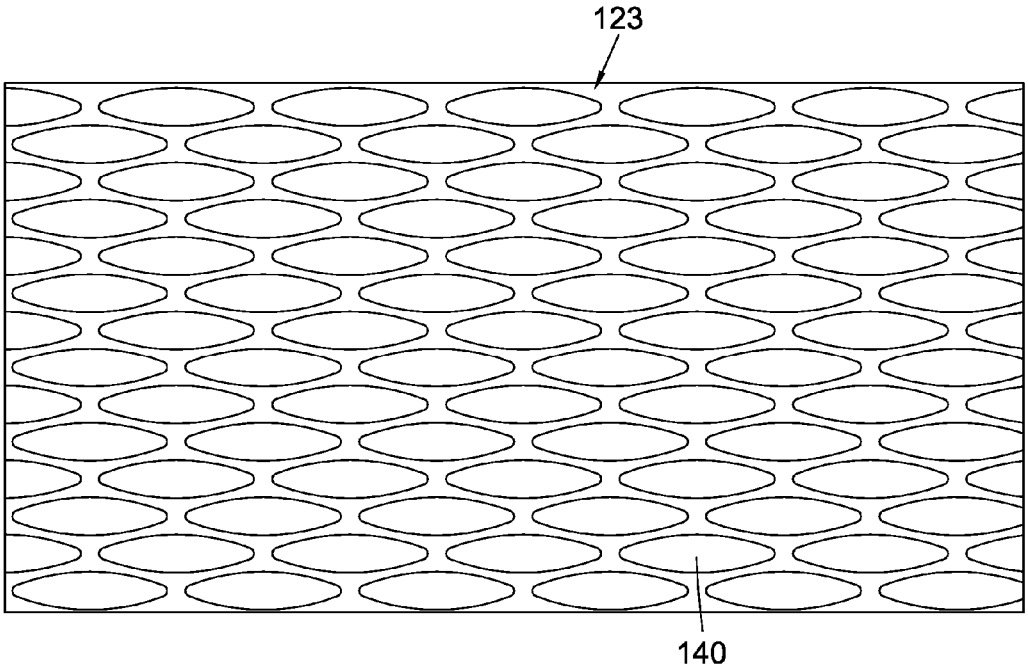

Reference is now made to FIGS. 8, 9 and 10 of the drawings, which illustrate an area of a metal sheet 123 which may be used to form a shroud 124 for a sandscreen in accordance with an embodiment of the present invention. FIG. 9*a* illustrates the form of the sheet 123 as it would be used to form a shroud, such as the shroud 24 described above, including a multitude of initially closed openings in the form of staggered or overlapping axial slots 140. On activation of the sandscreen, the shroud and thus the sheet is circumferentially extended, such that the slots 140 open to the form illustrated in FIG. 9*b*.

Figure 10A:
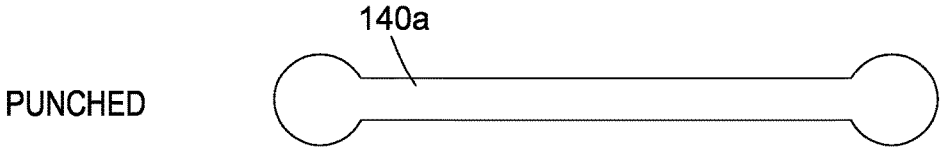
FIGS. 10*a*, 10*b* and 10*c* show a slot form of the sheet of FIGS. 9*a* and 9*b;*
Figure 10B:
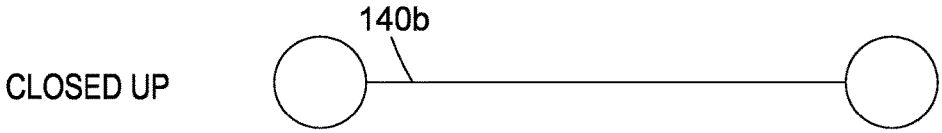
Figure 10C:
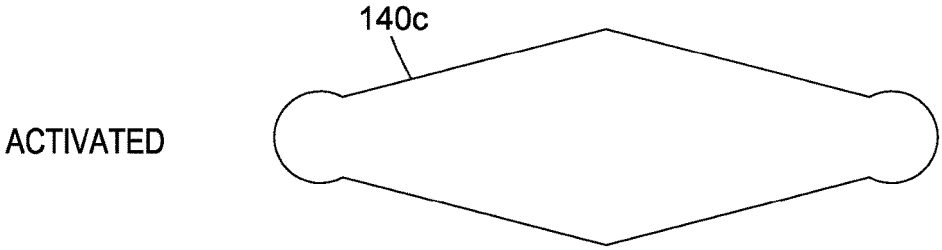

The slots 140 are initially formed in the sheet by punching, and the initial slot form 140*a* may be as illustrated in FIG. 10*a*, with the slot ends being enlarged to produce an open-ended form and avoid or minimise stress concentrations. However, following the punching of the slots, the sheet 123 is subject to a lateral compression force which causes the slots to close and assume the form 140*b* as illustrated in FIG. 10*b*. This is the form the slots take when the sheet is formed into a shroud. On activation of the sandscreen, the slots 140 are extended and assume the form 140*c* as illustrated in FIG. 10*c*.

This slot form offers the operator numerous advantages. In the closed-up form 140*b*, the slots 140 restrict fluid access from the exterior of the screen to the screen interior. Thus, the weave and other filter elements of the sandscreen are isolated from the fluid in the well, which is likely to include drilling fluid carrying fine suspended solids which otherwise might plug or fill the weave. Also, if the shroud comes into contact with the bore wall as the completion string is being run into the well, any filter cake or the like on the well bore wall will be kept away from the weave. If the slots in the shroud were open, it is possible that filter cake and other material could be pushed and packed into the weave, limiting its permeability.

The closed slots 140 also tend to produce a completion string which generates less friction when it contacts the bore wall, thus facilitating running in and increasing the likelihood of the completion being run to the target depth. The closed slots 140 are also far less likely to catch or hang-up on sharp or rough edges as might be present at milled casing windows or multi-lateral junctions.

Figure 11:
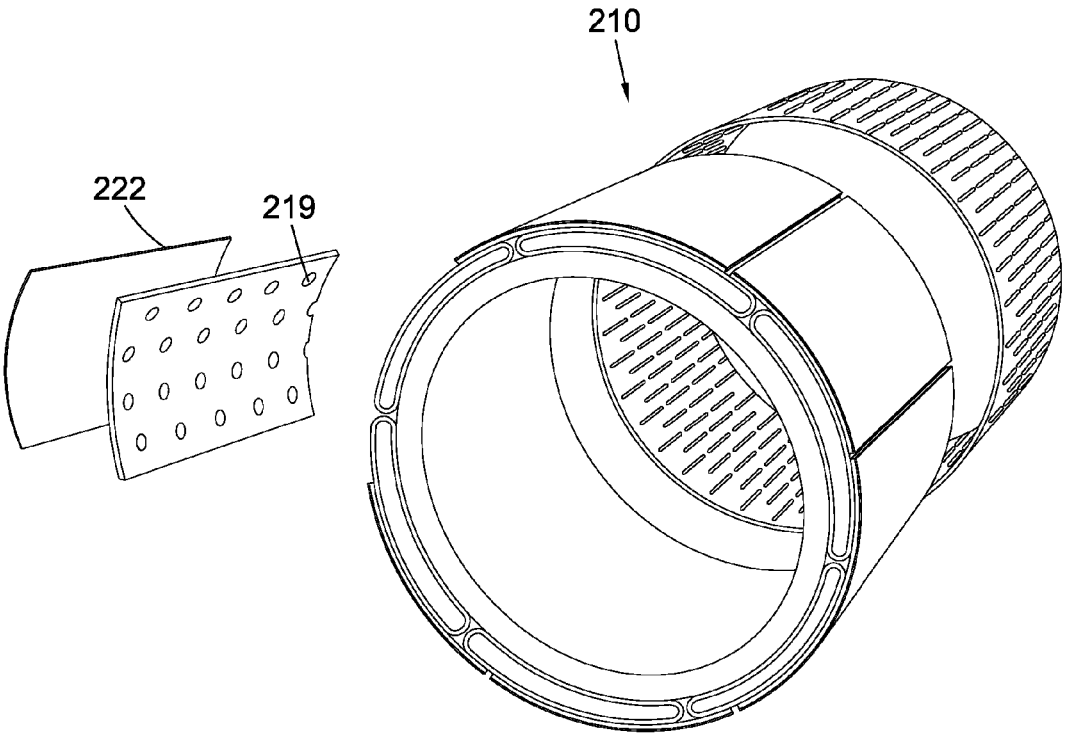
FIG. 11 is a partially exploded view of a section of sandscreen in accordance with an embodiment of the present invention.
Figure 12:
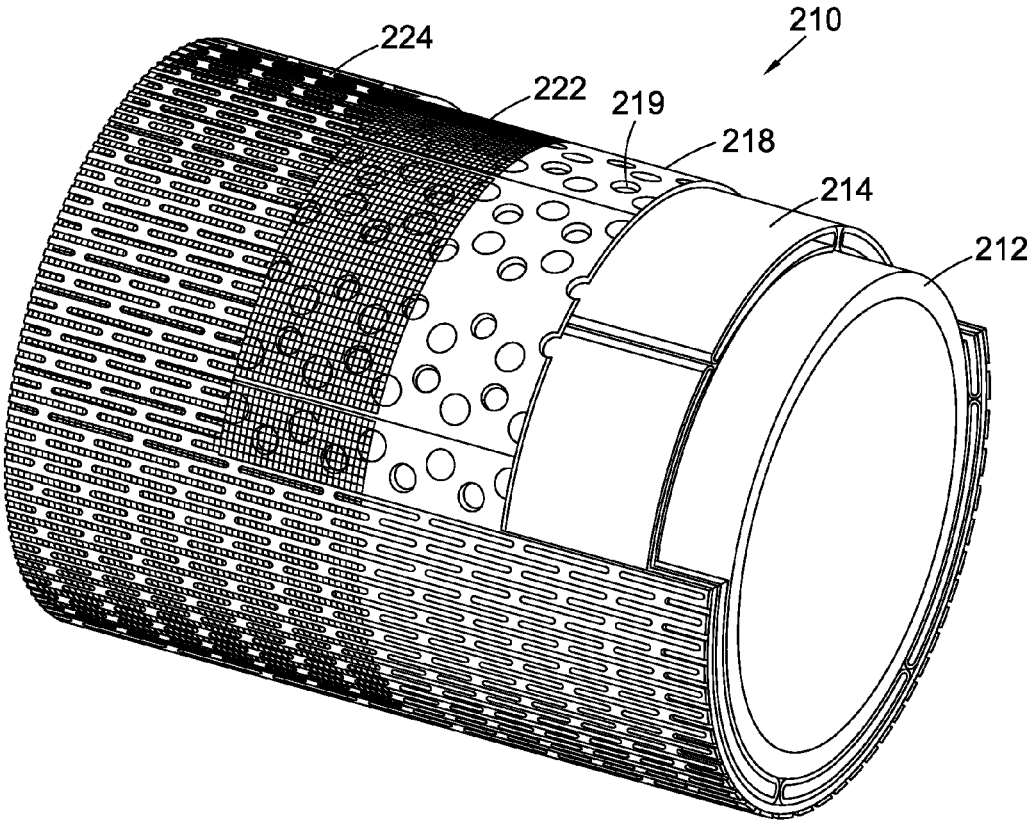
FIG. 12 is a part cut-away view of the sandscreen section of FIG. 11.
Figure 13:
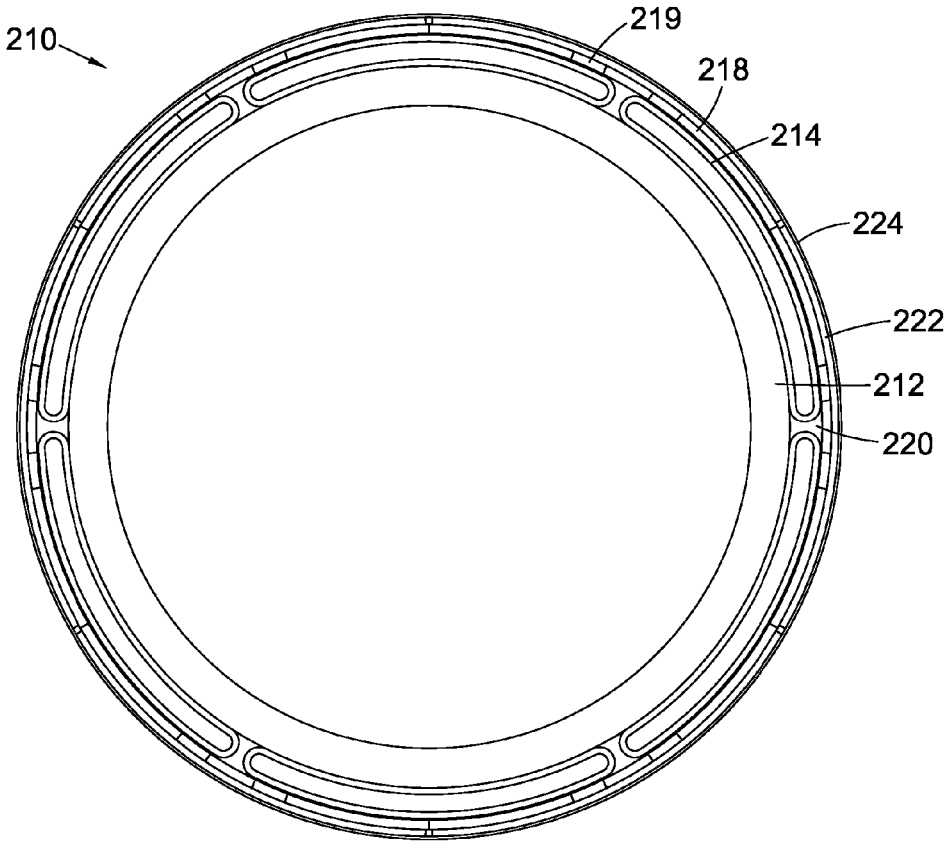
FIG. 13 is a sectional view of the sandscreen of FIG. 11.

Reference is now made to FIGS. 11, 12 and 13 of the drawings which illustrate a further alternative sandscreen 210 in accordance with an embodiment of the present invention. This screen 210 shares many features with the screen 10 described with reference to FIGS. 2 and 3, however in this case the weave is provided in the form of six separate weave strips 222, each strip being mounted on a respective support strip 218, each of which defines flow apertures 219.

The support strips 218 collectively form a support/drainage layer. The strips 218 are apertured and dimpled to permit fluid to flow through and under the strips 218, although the edges of each strip are free of openings and dimples to permit a seal to be formed between the edge and the underlying element.

One edge of each support strip 218 is fixed and sealed to a respective activating element 214, for example, by a bead of glue or a weld. The other edge sits over an adjacent activating element 214 and is free to move across the surface of the element 214 as the elements 214 are activated. However, the "free" edge of each support strip 218 remains substantially in sealing contract with the underlying activating element 214. Thus, fluid flowing from the surrounding formation through the shroud 224, through the weave 222, into the gaps 220 between the activated elements 214, and then into the base pipe 212, must pass through the weave 222 and also through the apertures 219 in the support strips 218.

This arrangement offers substantial advantages when fabricating the screen joint 210. In particular, the support strips 218 and the associated weave strips 222 may be fabricated and then mounted on the elements 214 as unitary parts. This contrasts with typical conventional sandscreen assemblies, in which a single long (c10 m) and flexible length of weave must be wrapped around a tubular assembly and secured in place using, for example, ties, clamps and spot welds. The advantages are particularly apparent in relation to weave materials with more challenging handling characteristics, for example reverse Dutch twill, which is relatively stiff and does not cope well with tension, as would be experienced by a conventionally wound weave on activation of the screen joint.

Figure 14:
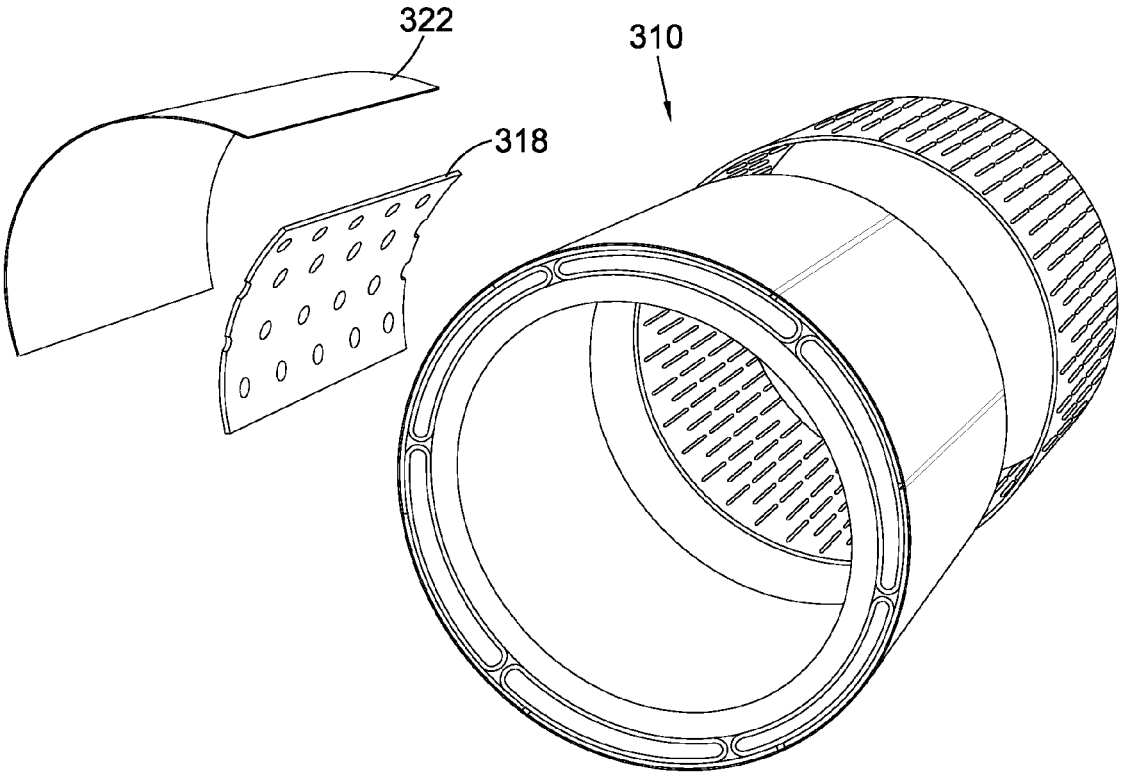
FIG. 14 is a partially exploded view of a section of alternative sandscreen in accordance with an embodiment of the present invention.
Figure 15:
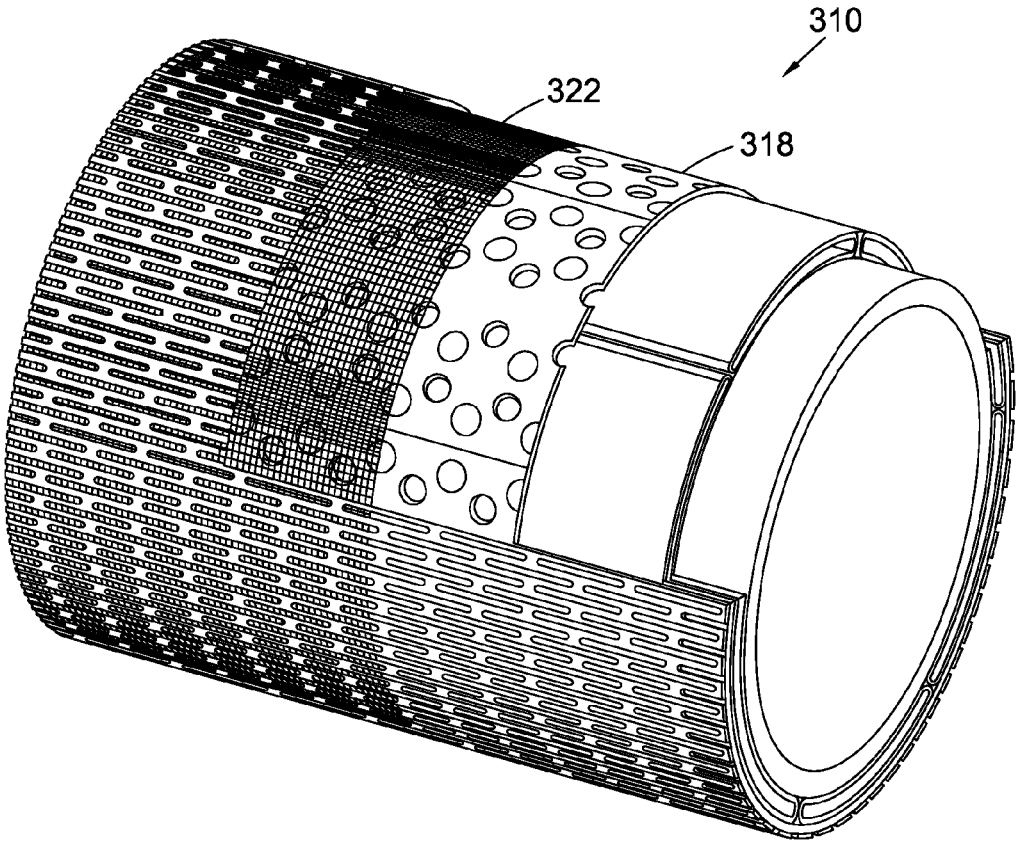
FIG. 15 is a part cut-away view of the sandscreen section of FIG. 14.
Figure 16:
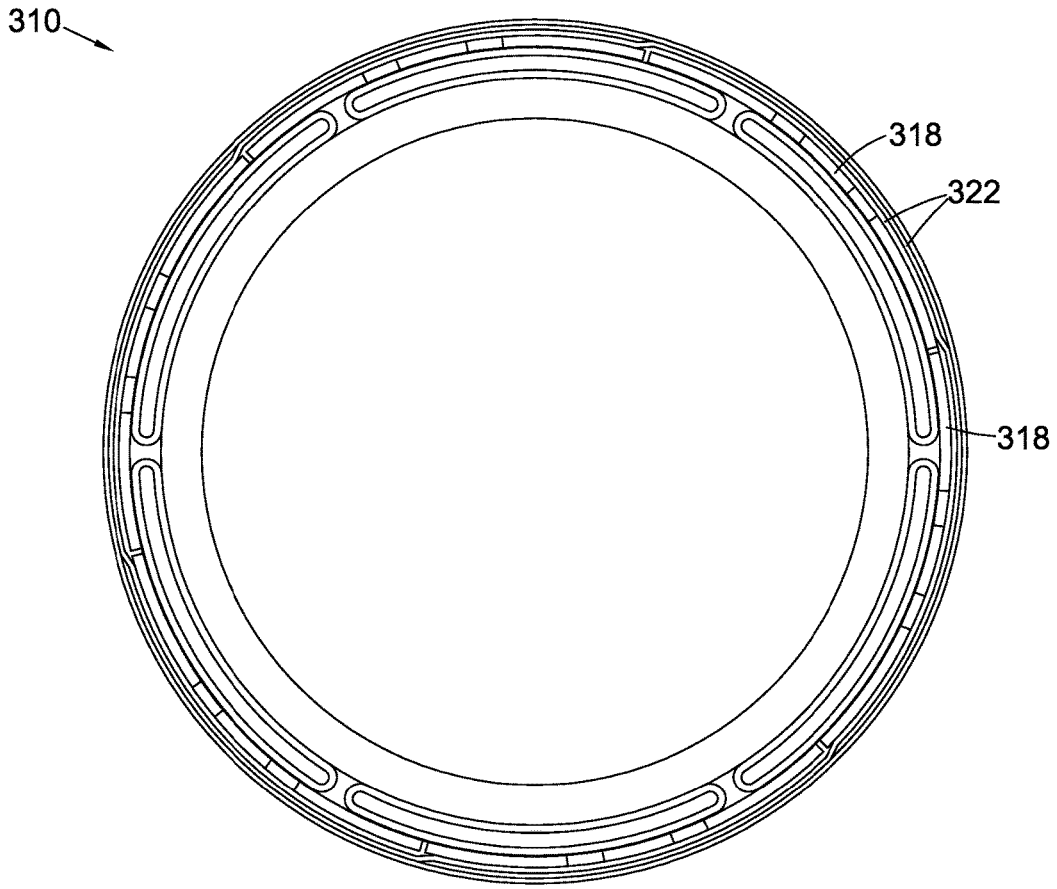
FIG. 16 is a sectional view of the sandscreen of FIG. 14.

Reference is also made to FIGS. 14, 15 and 16 of the drawings, which show a sandscreen joint 310 which is similar to the joint 210 described above, however in the sandscreen 310 the weave strip 322 associated with each support strip 318 is twice as wide as the associated support strip 318, and when the support strips 318 are mounted on the activating elements 314 the free edge of the associated weave strip 322 is positioned to over-lie the adjacent support strip 318, as is perhaps best illustrated in FIG. 16.

On activation of the screen 310, the support strips 318 will separate, however the overlapping weave strips 322 ensure that any fluid passing from the formation into the base pipe 312 must pass through the weave 322, such that it is not necessary to seal the edges of the support strips 318 to the underlying activating elements 314.

Figure 17:
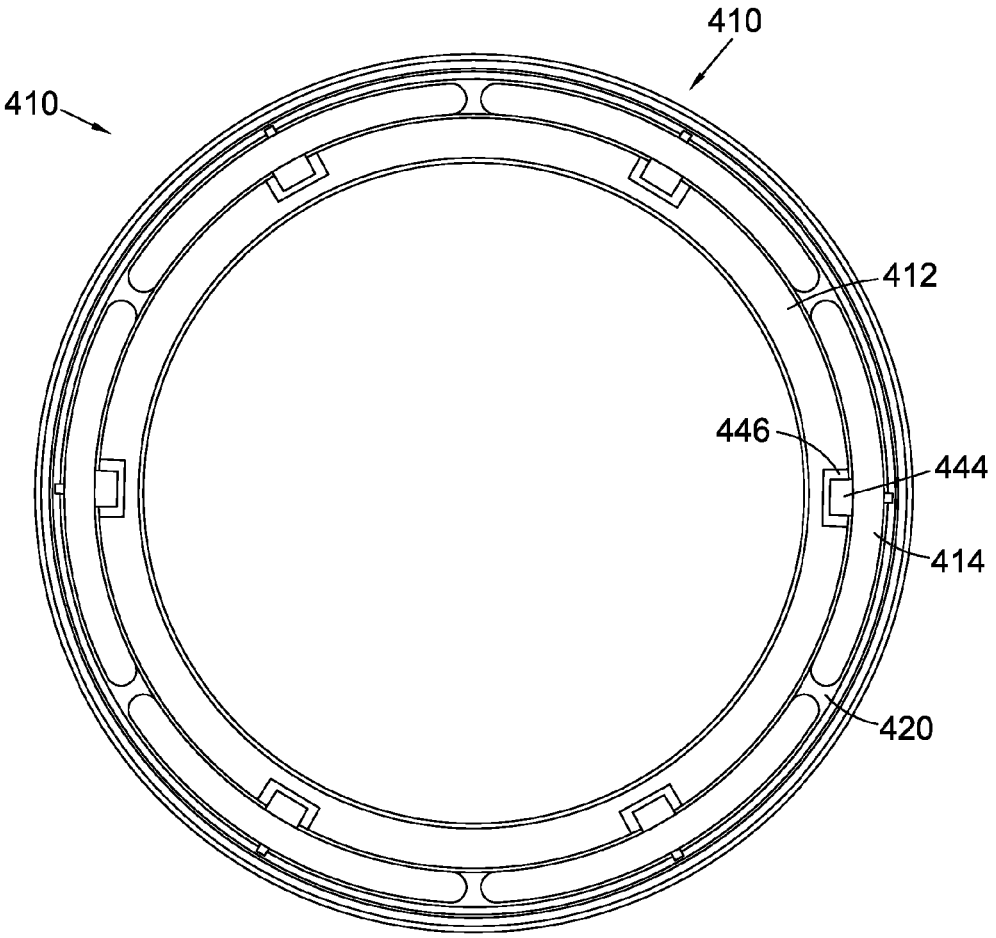
FIG. 17 is a sectional view of a sandscreen in accordance with an embodiment of the present invention.

Reference is now made to FIG. 17 of the drawings, which illustrates a section of a sandscreen joint 410 in accordance with an embodiment of the present invention. The joint 410 may share features with the sandscreen 10 described above with reference to FIGS. 2 and 3 of the drawings, or with any of the other aspects or embodiments described herein. However, in this embodiment a short spigot or dowel 444 extends radially inwardly from the base of the mid-joint each activating element 414 to engage with the corresponding blind recess 446 formed in the outer wall of the base pipe 412. Of course, dowels 444 could be provided at a plurality of locations on each element, and a typical joint (c.13 m long) may feature three axially-spaced dowels per element 414.

The ends of the elements 414 may be retained as described in GB2492193A, or by any other appropriate means. However, by fixing three dowels 444 on the inner face of each activating element 414, the location of each element 414 relative to the base pipe 412 is maintained as the elements 414 are inflated. As noted above with reference to, for example, FIG. 3 of the drawings, as the activating elements 414 are inflated the gaps 420 between the elements 414 will increase. In certain circumstances it is possible that sections of the activating elements 414 would shift by moving circumferentially around the base pipe 412. This could have an impact on the form of the activated screen 410. For example, movement of the elements 414 could make it more difficult to achieve an activated screen having a circular cross section resulting in areas where the outer surface of the activated screen 410 was not in contact with the bore wall.

Figure 19A:
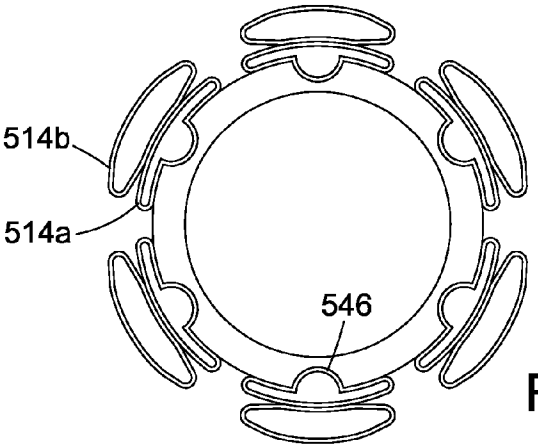
FIGS. 18*a* and 18*b*, and 19*a* and 19*b*, are views of a sandscreen having stacked inflatable elements, in accordance with an embodiment of the present invention.
Figure 19B:
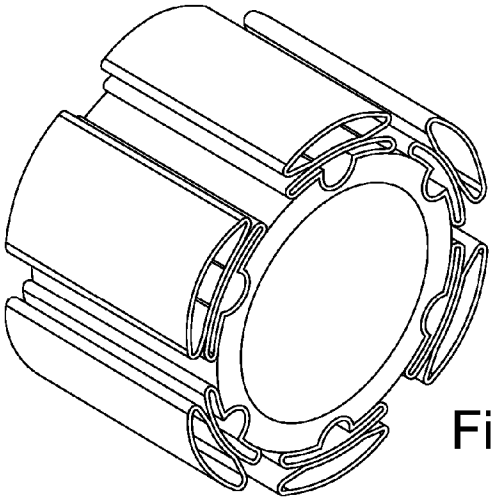
Figure 18A:
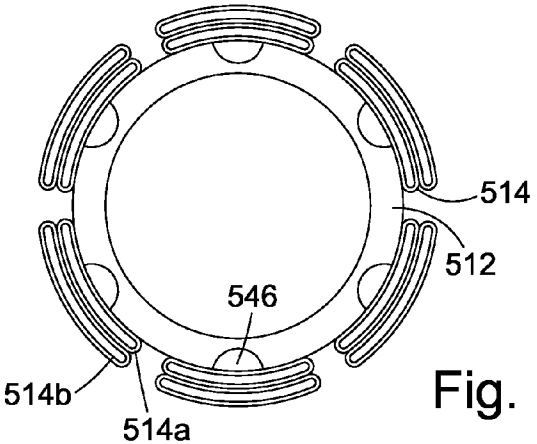
Figure 18B:
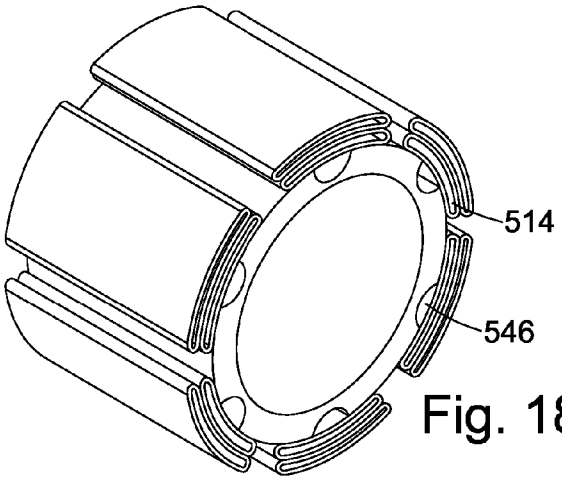

FIGS. 18 and 19 of the drawings illustrate an alternative arrangement in which the location of activating elements 514 may be maintained relative to a base pipe 512. In FIGS. 18 and 19 only the base pipe 512 and activating elements 514 of a screen are illustrated. It will be noted that the base pipe 512 features axial scallops 546 which extend along the base pipe 512 centrally of the activating elements of 514. Thus, as the elements 514 are activated, a central inner wall portion of each element 514 extends into the respective scallop 546, as illustrated in FIGS. 19*a* and 19*b*, and therefore serves to maintain the axial positioning of the element 514 on the base pipe 512.

It will also be noted from FIGS. 18 and 19 that each activating element 514 is formed of two radially stacked chambers or cells 514*a*, 514*b*. This facilitates provision of sandscreens or other arrangements capable of providing a high degree of expansion without requiring extensive deformation of the metal forming the elements 514.

The individual cells or chambers of the activating elements 514 are formed of individual tubes which may be in fluid communication or may be inflated individually.

Figure 20B:
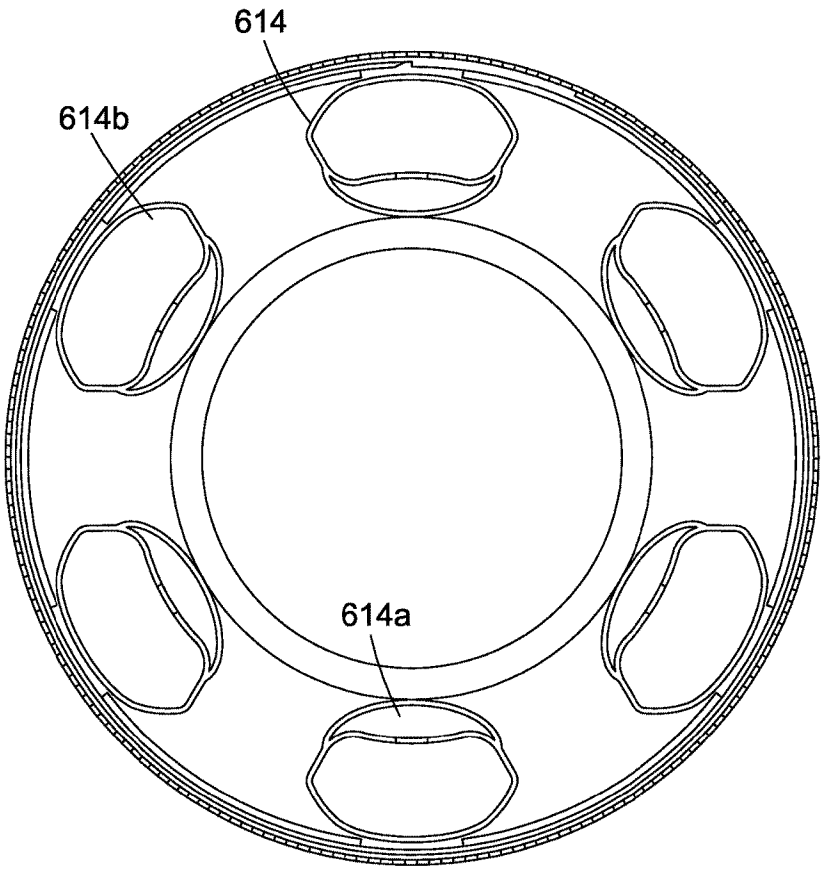
FIGS. 20*a* and 20*b* are sectional views of a sandscreen having multi-cell inflatable elements, in accordance with an embodiment of the present invention.
Figure 20A:
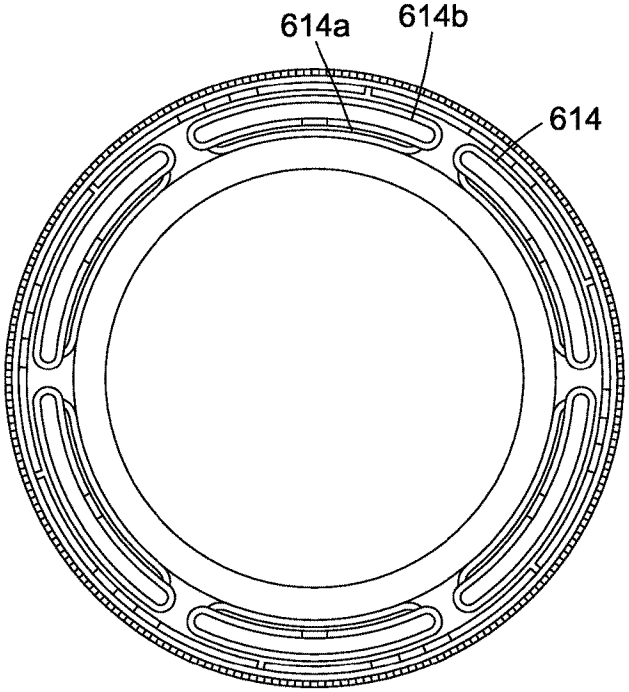

An alternative form of activating element 614 is illustrated in FIG. 20, in which multiple cell activating elements 614 are formed by attaching a strip of metal to the base of a chamber and forming an aperture in the common wall. Of inflation of such an element 614, the lower cell 614*a* inflates and, as is apparent from FIG. 20*b*, provides for an enhanced degree of extension of the sandscreen 610.

The arrangement of FIG. 20 offers the advantage of permitting provision of an element 614 with a relatively low initial profile, and thus an apparatus with a smaller inactivated diameter. Where two separate chambers or cells are provided, as illustrated in FIGS. 18 and 19, there is a minimum acceptable bend radius for the material, typically metal, forming the chamber walls, such that the minimum height of the edges of the retracted element is at least four times this minimum bend radius. However, the element 614 includes only a single chamber 614*b* featuring the minimum bend radius, which need not be provided in connection with strip of material forming the lower cell.

Figure 21B:
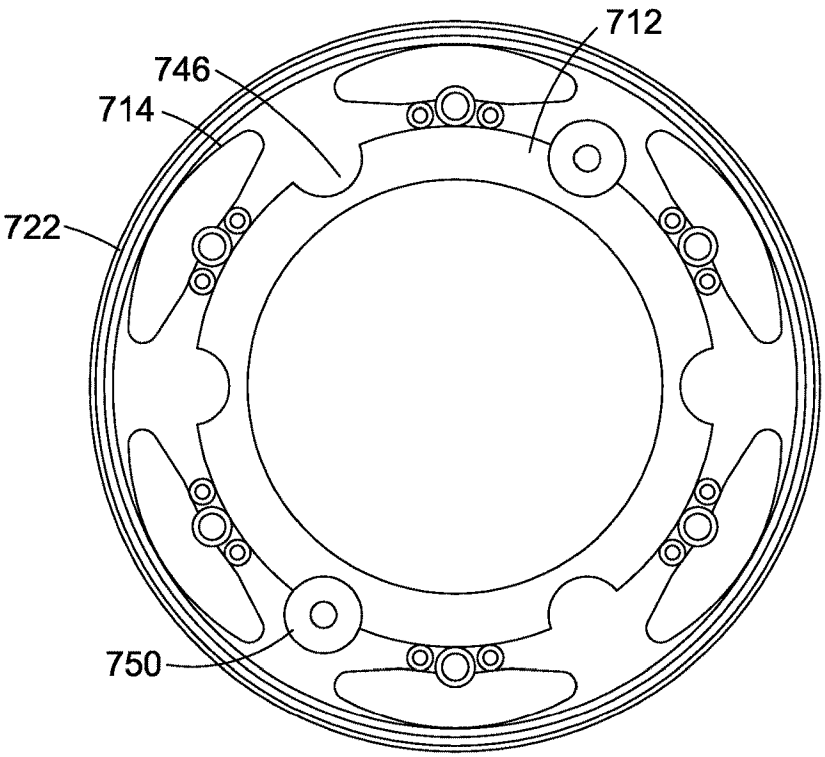
FIGS. 21*a* and 21*b* are end view of sandscreens in accordance with an embodiment of the present invention.
Figure 21A:
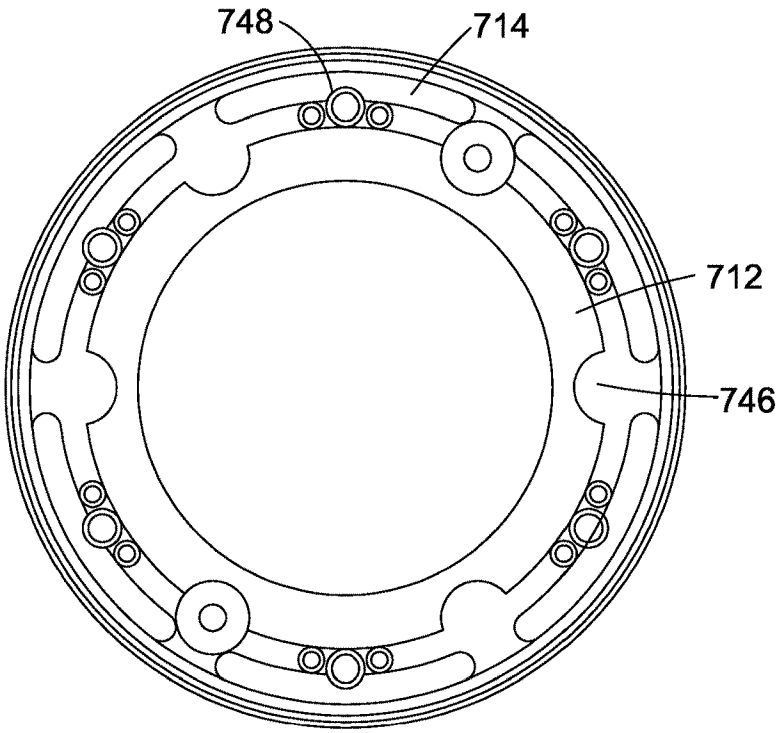

Reference is now made to FIGS. 21*a* and 21*b* of the drawings, which illustrate an alternative arrangement in which activating elements 714 are mounted on a base pipe 712 via smaller diameter stilts or spacers 748 which may also serve as control or electric lines. The stilts 748 space the activating element 714 from the outer surface of the base pipe 712 and thus provide a larger flow area between the base pipe 712 and the weave 722.

In this embodiment it will be noted that each spacer includes three circular cross-section pipes or tubes, the central tube being slightly larger and extending into a corresponding recess formed in the adjacent element wall. It will also be noted that the outer surface of the base pipe 712 between the elements 714 is provided with axially extending scallops or recesses 746 which further serve to increase the flow area between the base pipe 712 and weave 722, and which may also provide location for other items, in this case electronic gauges 750.

Figure 21C:
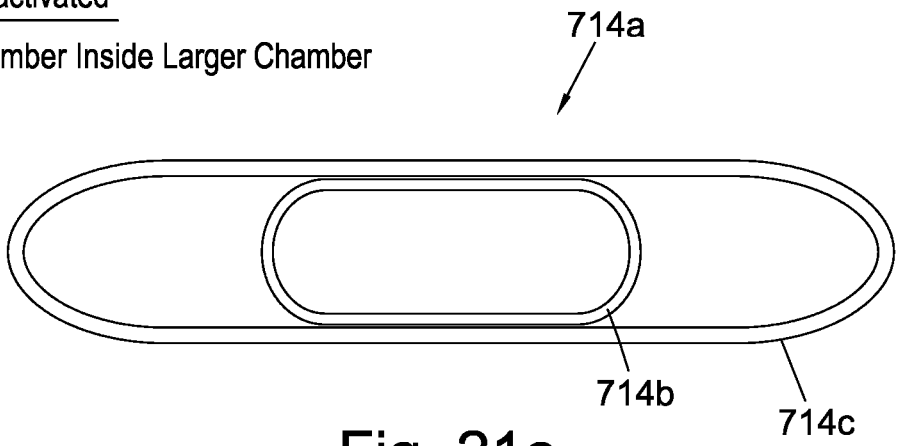
FIGS. 21*c* and 21*d* are sectional views of inflatable elements in accordance with embodiments of the present invention.
Figure 21D:
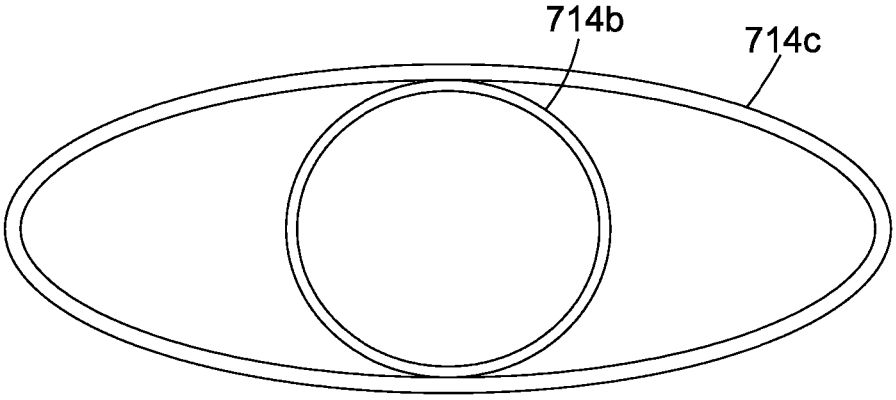

FIGS. 21*c* and 21*d* are sectional views of inflatable elements 714*a* in accordance with embodiments of the present invention which may be utilized in various aspects of the invention. The elements 714*a* feature an inner and an outer cell 714*b*, 714*c*. The cells are inflatable, with the smaller inner cell 714*b* assuming a circular form to support a central portion of the larger outer cell 714*c*.

Figure 22:
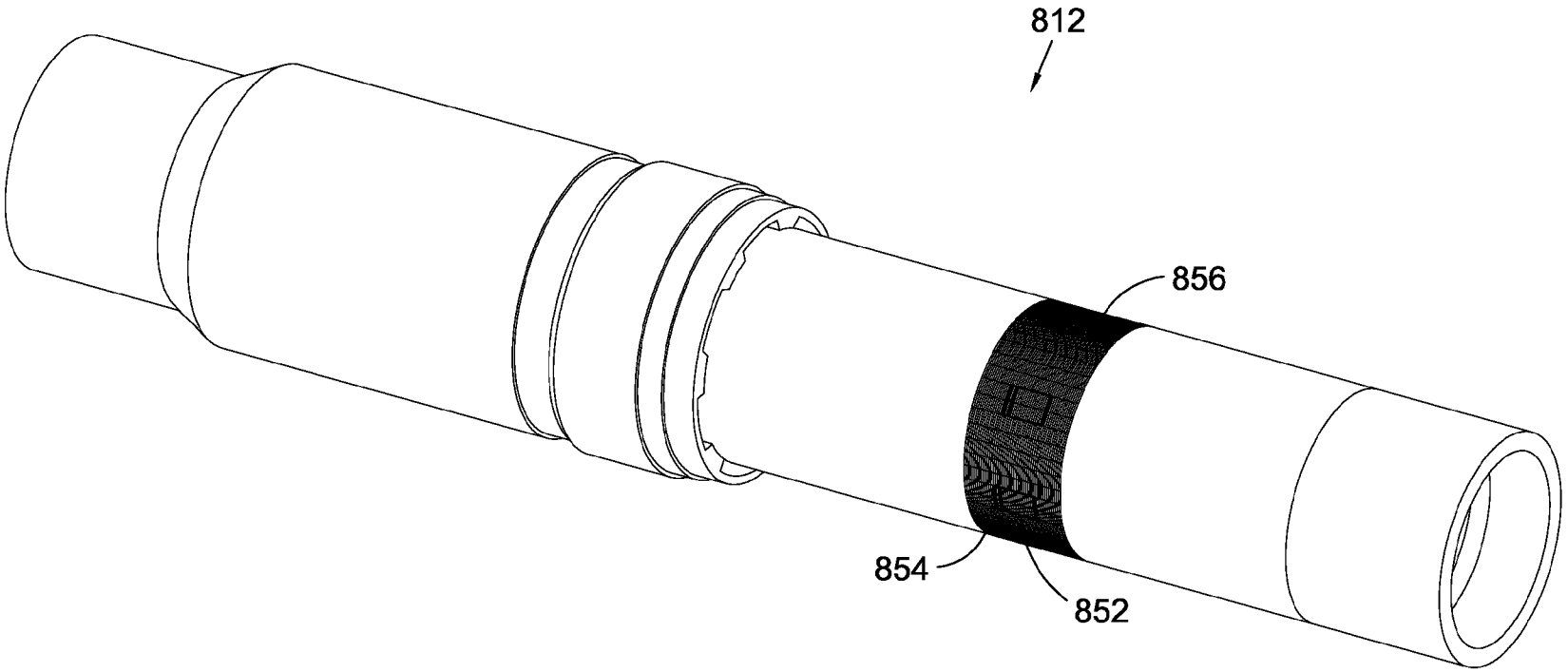
FIG. 22 is a perspective view of part of a sandscreen made in accordance with an embodiment of the present invention.

Reference is now made to FIG. 22 of the drawings, which illustrates a valve section 812 as would be provided at an end section of a base pipe of a sandscreen in accordance with another embodiment of the present invention. This Figure illustrates the flow ports 852 that permit fluid to flow between the interior and the exterior of the valve section 812. An annular recess 854 is provided in the outer wall of the valve section 812 and accommodates a band of filter material 856. The filter material 856 will be of no finer gauge than the one that is provided on the screen and as such the filter material 856 will not normally provide any filtering function. However, in the event of damage or failure of the weave, the filter material 856 will prevent particulates from flowing into the flow port 852 and into the base pipe. Thus, a failure of the associated weave will not result in large volumes of particulate material flowing into the base pipe and creating problems for the operator.

Reference is now made to FIGS. 23 and 23*a* to 23*e* of the drawings, which illustrate parts of a valve 930 for controlling the activation or inflation of elements 914 of a sandscreen in accordance with an embodiment of the present invention. As will be described, the valve configuration permits an operator to utilize relatively high fluid pressure to unlock the valve 930 and then utilize a lower pressure to inflate the associated activating elements 914.

The valve 930 includes an indexing sleeve 960 that is axially moveable within a valve chamber 962 to control the flow of fluid between inflation ports 964 in the base pipe wall and inflation passages 966 leading to respective activating elements 914. The movement of the sleeve 960 is controlled by the interaction of a indexing profile 968 and follower pin 970 mounted on the valve body 972 (two slots 968 and respective pins 970 are provided at 180 degree spacings). The changing relationship between the slot 968 and pin 970 as the valve 930 is activated is illustrated in FIGS. 23*aa* to 23*ee* of the drawings.

A compression spring 974 urges the indexing sleeve 960 in one axial direction, while internal fluid pressure may act on a piston 976 to urge the sleeve 960 in the opposite direction.

Figure 23:
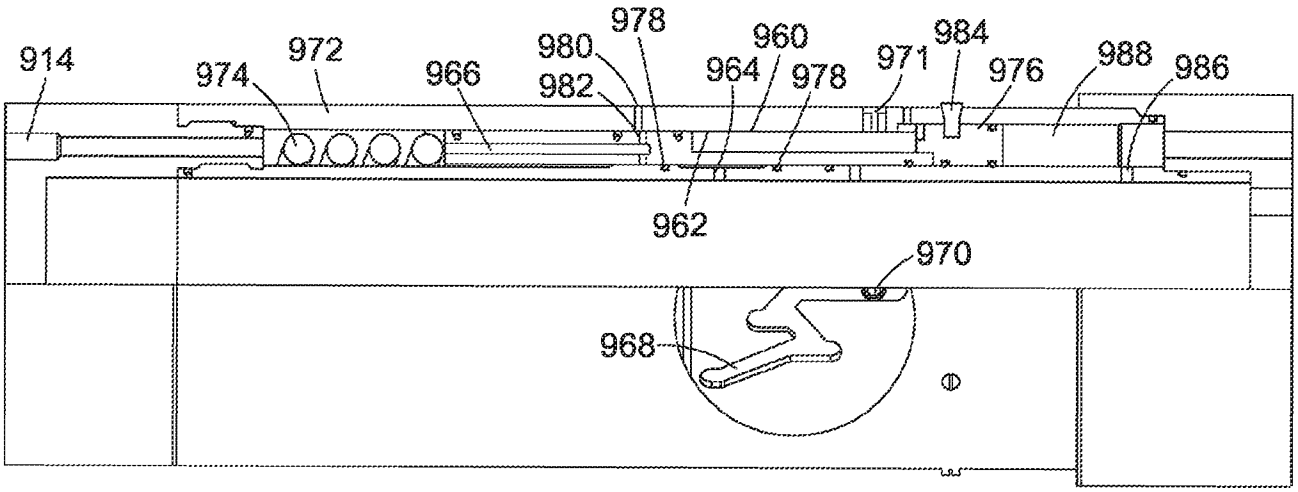
FIGS. 23 and 23*a* to 23*e* are part-sectional views of a valve for downhole apparatus in accordance with an embodiment of the present invention.
Figure 23A:
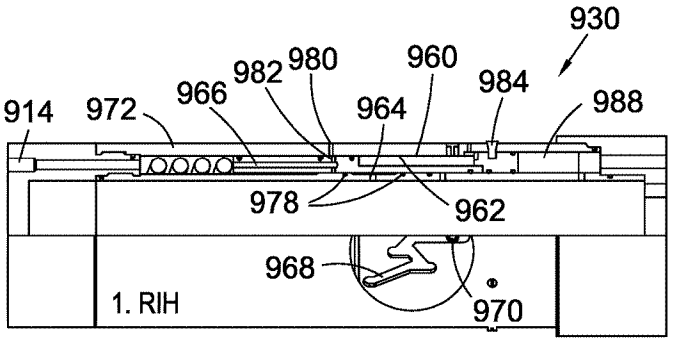
Figure 23B:
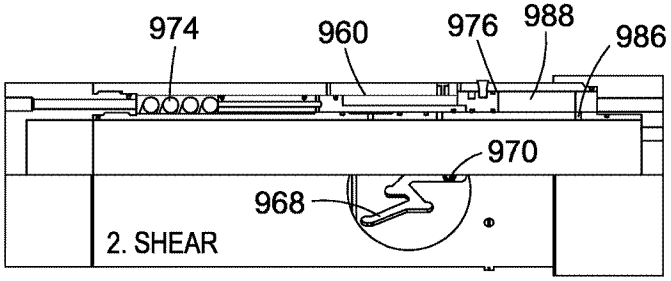

FIG. 23*a* illustrates the configuration of the valve when the sandscreen is being run in hole. It will be noted that the inflation ports 964 are isolated by the indexing sleeve 960 and appropriate seals 978. However, to provide for hydrostatic balance during running-in-hole (RIH) the inflation passages 966 are initially in fluid communication with the exterior of the sandscreen via a breather port 980 and sleeve passages 982. Furthermore, the sleeve 960 is initially locked in position by the piston 976, which is fixed in position relative to the valve body 972 by a releasable retainer, such as a shear ring or the illustrated shear pins 984.

If it is desired to unlock the indexing sleeve 960, an elevated fluid pressure is applied to the interior of the string. This pressure is communicated, through actuating ports 986, to a chamber 988 on one side of the piston 976, and if the pressure is sufficient the pins 984 will shear and the piston 976 and sleeve 960 will move. However, only a limited movement of the piston 976 and sleeve 960 is possible, as the pin 970 is already located close to the end of the first leg of the indexing profile 968, as illustrated in FIGS. 23*aa* and 23*bb*, which correspond to FIGS. 23*a* and 23*b*.

Figure 23C:
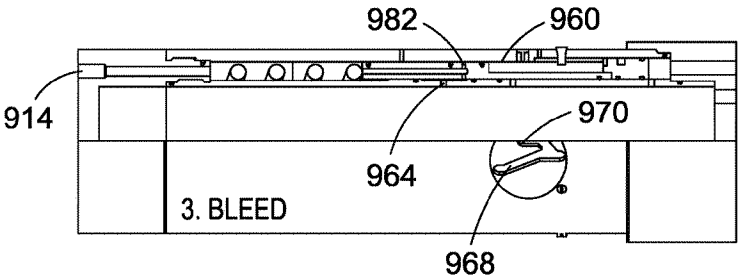

On bleeding off internal pressure, the spring 974 moves the indexing sleeve 960 in the opposite direction, the degree of movement being limited by the engagement between the indexing profile 968 and the pin 970 (see FIG. 23*cc*). This degree of movement is selected to place the sleeve passages 982 in fluid communication with the inflation ports 964, thus providing a passage for fluid to flow from the interior of the screen and into the activating elements 914. In this configuration the breather ports 980 are isolated from the sleeve passages 982.

Figure 23D:
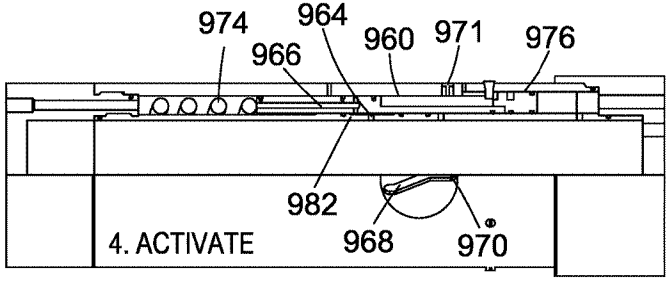
Figure 23E:
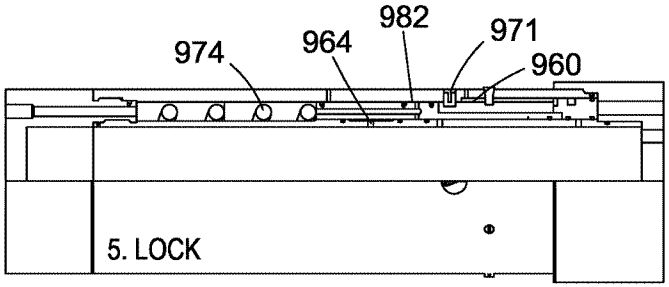
Figure 23A:
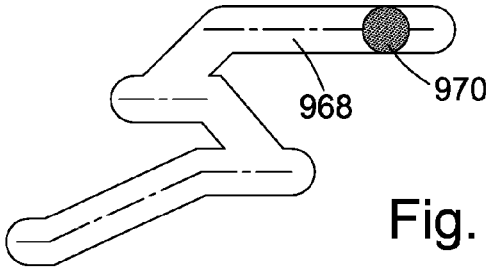
Figure 23B:
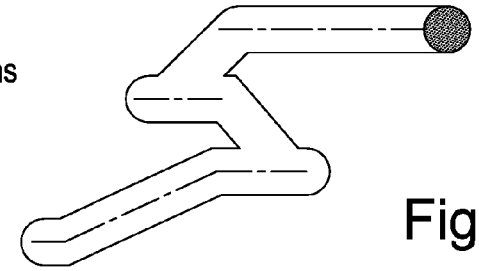
Figure 23C:
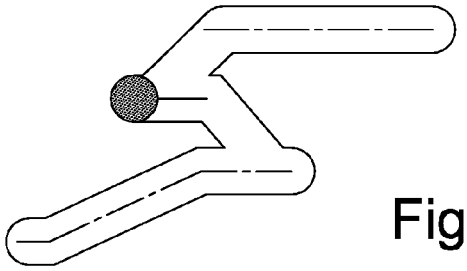
Figure 23D:
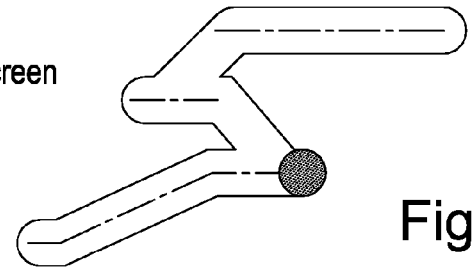
Figure 23E:
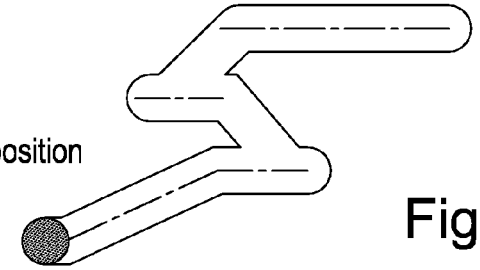

If the internal fluid pressure is then increased once more to inflate/activate the elements 914, the piston 976 is actuated to translate the sleeve 960 and compress the spring 974, however the movement of the sleeve 960 is constrained by the interaction of the indexing profile 968 and pin 970 (see FIG. 23*dd*) such that the inflation ports 964 remains in fluid communication with the sleeve passages 982 and the inflation passages 966, as illustrated in FIG. 23*d*.

The inflation path to the elements 914 is provided with an appropriate one-way valve (not shown) to trap the inflation pressure within the activation elements 914, such that when pressure is bled off once more the inflation pressure is trapped within the elements 914. However, a further seal is created by the movement of the indexing sleeve 960 under the influence of the spring 974 such that the inflation ports 964 and the sleeve passages 982 are moved out of alignment. The indexing sleeve 960 is also moved to locate the pin 970 at the end of the indexing profile 968 (see FIG. 23*ee*), which allows the piston 976 to move to a fully balanced position, such that further internal pressure changes will not affect the piston 976. Thus, the sleeve 960 is effectively locked in position, permanently sealing off access to the elements 914.

Furthermore, an additional pair of sprung-loaded pins 971 are mounted on the valve body 972 and, on the sleeve 960 reaching the final position, are arranged to snap into respective flat-bottomed holes formed in the indexing sleeve 960, ensuring that the sleeve is mechanically locked in the closed off position.

Reference is now made to FIG. 24 of the drawings which illustrates a portion of a valve 931 for controlling flow of production fluid into the base pipe 912.

Figure 24A:
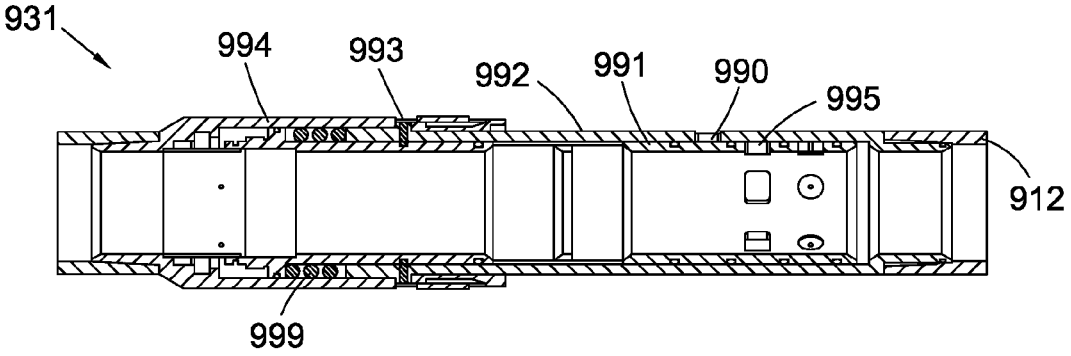
FIGS. 24*a* to 24*d* are sectional view of a flow valve arrangement for downhole apparatus in accordance with an embodiment of the present invention.
Figure 24B:
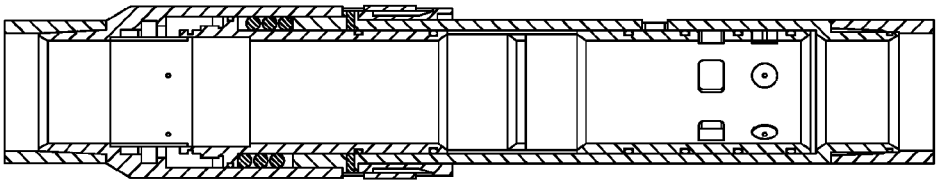
Figure 24C:
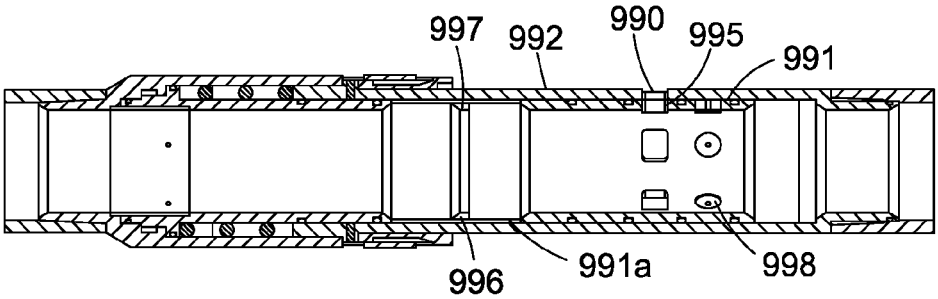

FIG. 24*a* shows the valve 931 in the run-in-hole configuration in which inflow ports 990 are closed by an internal sleeve 991. The inflow ports 990 are formed in an external sleeve 992 which is initially fixed to the internal sleeve 991 by shear pins 993. In a somewhat similar manner to the inflation valve arrangement described above with reference to FIG. 23, on being exposed to an elevated released pressure (following inflation of the activating elements as described above), a piston 994 formed on the inner sleeve 991 is exposed to internal pressure which, if sufficient, will shear the pins 993, permitting a degree of movement between the sleeves 991, 992, as illustrated in FIG. 24*b*. Once pressure is bled off, a compression spring 999 between the inner and outer sleeves 991, 992 moves the inner sleeve 991 back in the opposite direction to align sleeve ports 995 in the inner sleeve 991 with the inflow ports 990 in the outer sleeve 992, as illustrated in FIG. 24*c*. Production fluid may thus now flow into the base pipe 912.

Those of skill in the art will recognize that having the inflow ports 990 closed during run-in-hole, and in subsequent operations, offers numerous advantages. For example, if the inflow ports were always open, a completion incorporating screens otherwise made in accordance with this embodiment would tend to self-fill through the weave, increasing the risk of the weave becoming choked or plugged by material suspended in the fluid filling the bore.

Figure 24D:
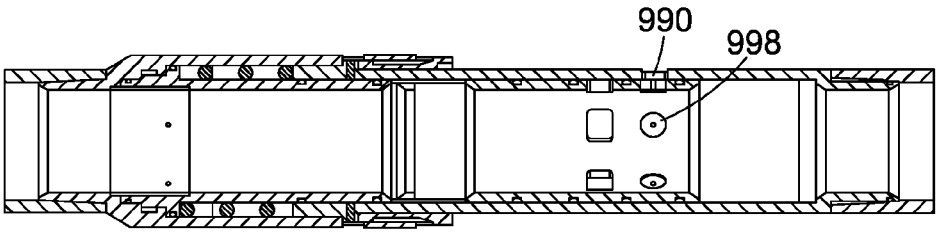

If at some point in the future it is desired to control or vary the flow of fluid through the inner flow ports 990, a mechanical shifting tool may be run into the bore to engage a profile 996 on a portion 991*a* of the internal sleeve. If a sufficient force is applied to the profile 996, shear pins 997 will fail and permit axial movement of the internal sleeve portion 991*a* relative to the external sleeve 992, and move the open sleeve ports 995 out of alignment with the inflow ports 990, and place ports provided with inflow control devices 998 in registration with the inflow ports 990, as illustrated in FIG. 24*d*.

Alternatively, in other embodiments, shifting the sleeve may shut off the inflow ports completely. Furthermore, a profile may be provided on the other end of the internal sleeve to allow a mechanical shifting tool to be run into the bore to move the sleeve in the opposite direction to re-open the ports. The different internal sleeve positions may be maintained by friction, or by providing a releasable retainer, such as a spring-loaded collet.

In the above examples the various valves are described as being located towards one end of a screen or joint. However, in other embodiments valves may be provided at both ends of the screen or joint, centrally of the screen or joint, or indeed at any appropriate location on the screen or joint.

Figure 25A:
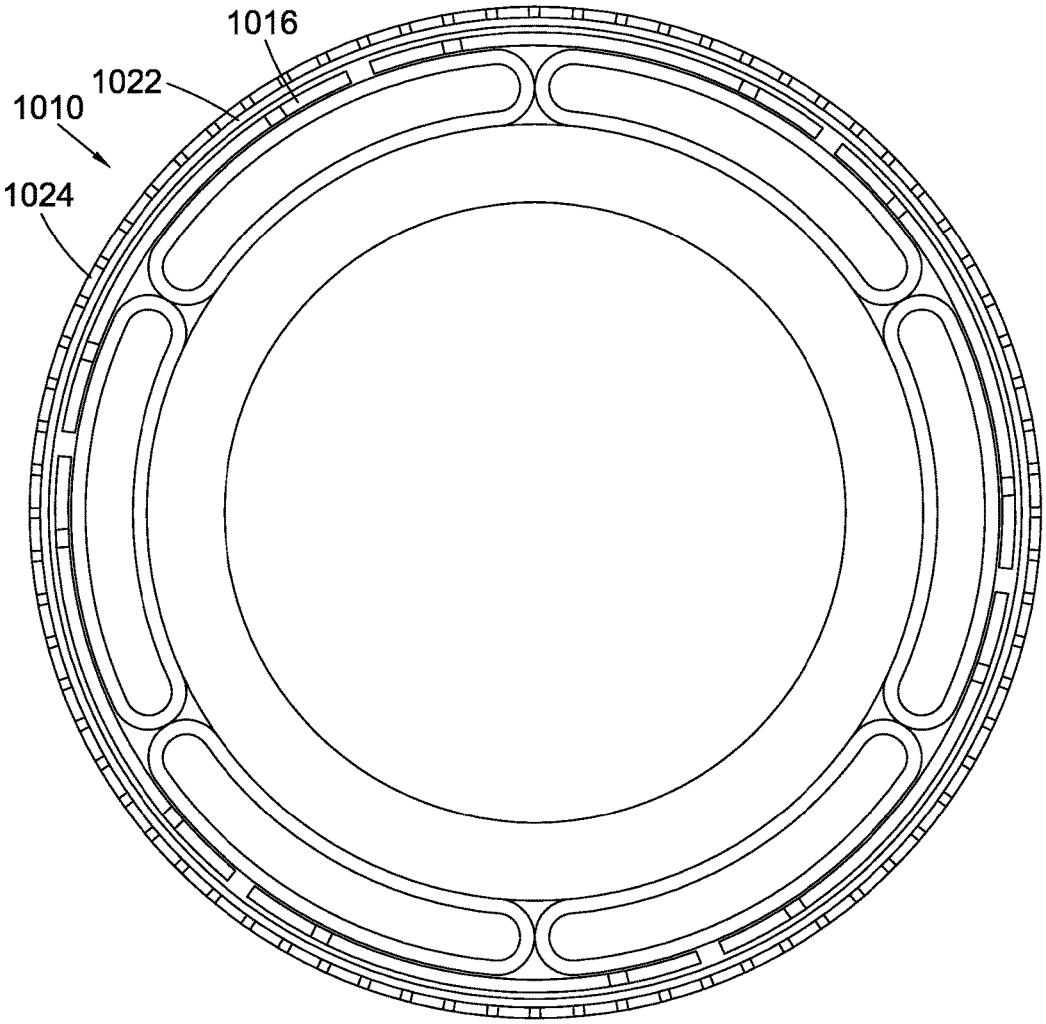
FIGS. 25*a* to 25*c* are sectional views of a bore lining arrangement in accordance with an embodiment of the present invention.
Figure 25B:
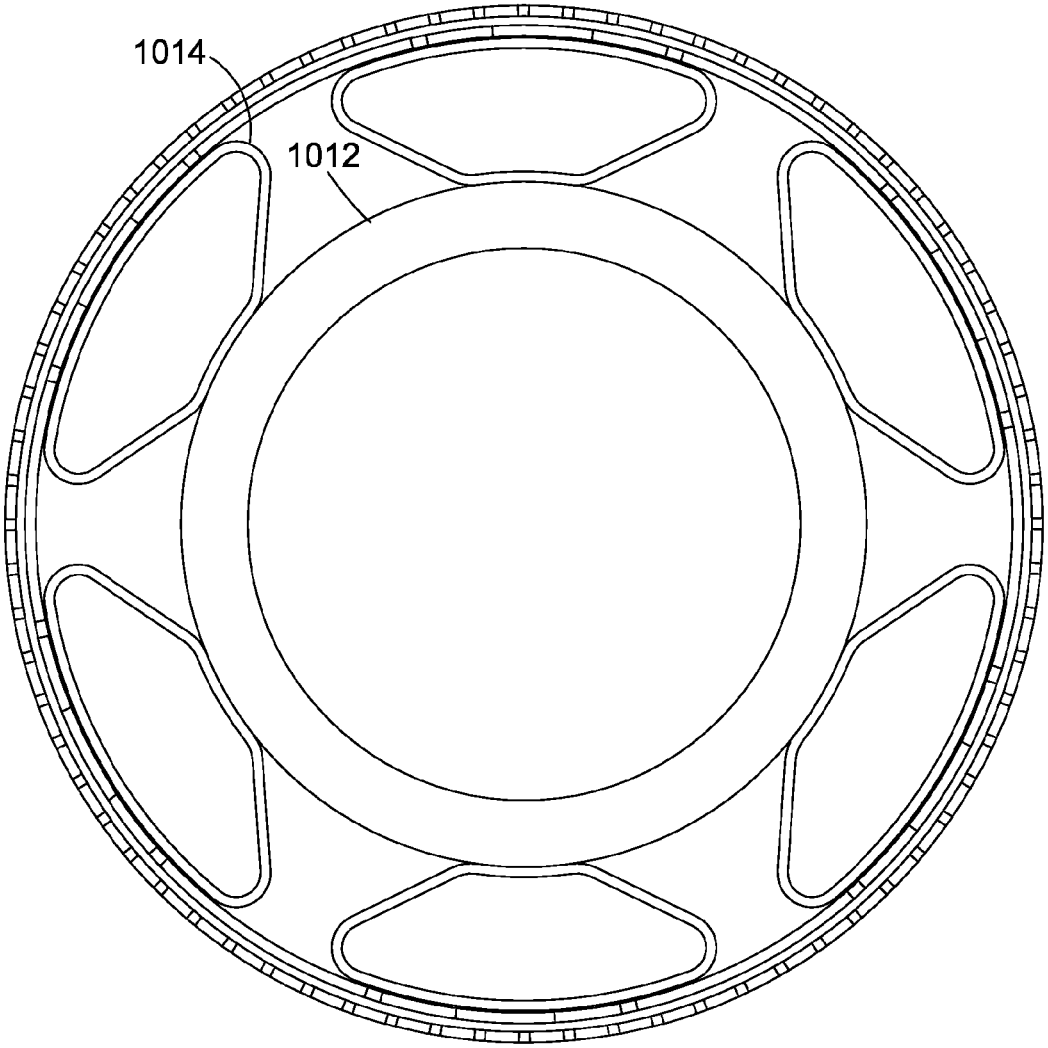
Figure 25C:
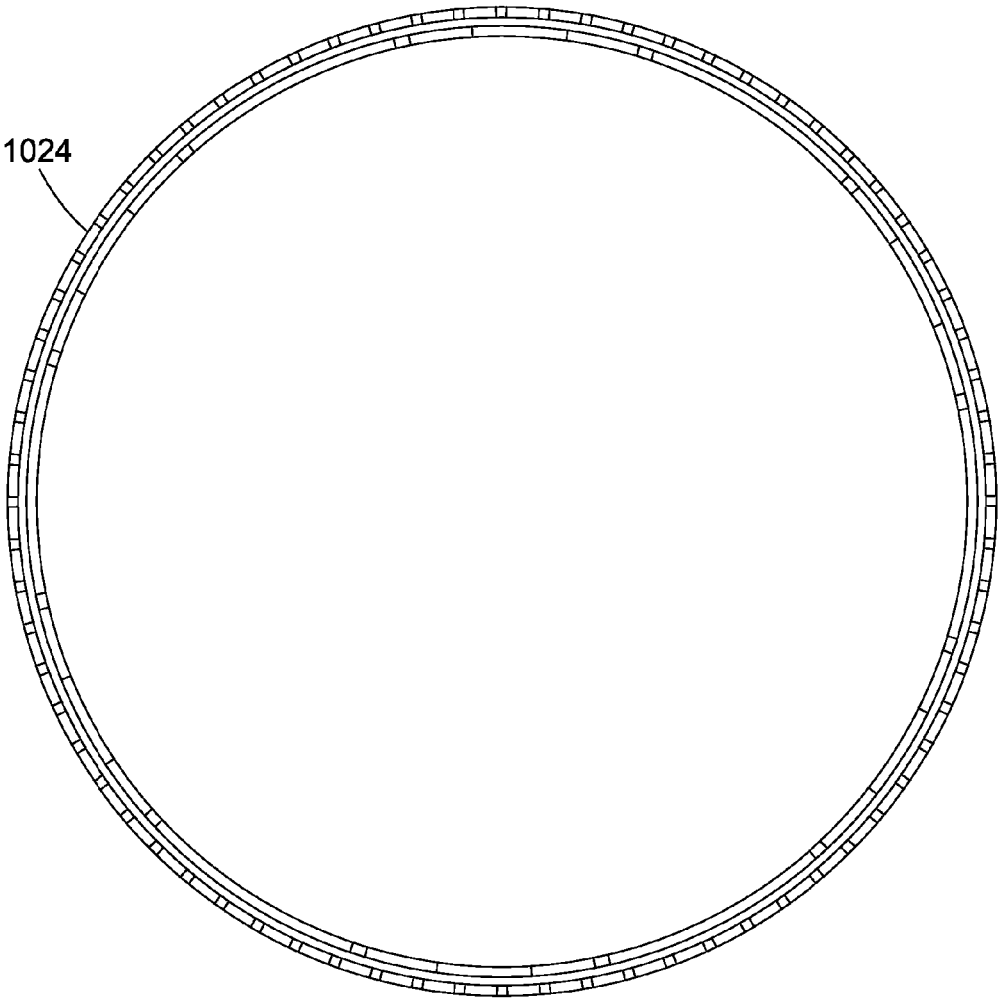

Reference is now made to FIG. 25 of the drawings, which illustrates an arrangement for use in lining a bore. In section the apparatus 1010 has a generally similar appearance to the sandscreen 10 described above. However, the external elements of the apparatus 1010, namely the drainage layer 1016, the weave 1022 and the shroud 1024 are detachable from the base pipe 1012 and the actuating elements 1014. Thus, after the apparatus 1010 has been run into a bore and activated, as illustrated in FIG. 25*b*, the activating elements 1014 may be deflated and inactivated and the base pipe 1012 and activating elements 1014 removed from the bore, leaving a bore lining in place, as illustrated in FIG. 25*c*. Where the bore to be lined is not producing, the weave 1022 may be omitted.

Reference is now made to FIG. 26 of the drawings, which illustrates apparatus suitable for use in a cementing operation, in particular for use in cementing an inner casing 1100 within an outer casing 1102. A sleeve 1104 is fixed, using shear pins, to the inner casing 1100 and in the initial fixed position the sleeve 1104 closes cement ports 1106 and inflation ports 1108 provided with one-way valves which communicate with annular inflatable elements 1110 mounted externally of the inner casing 1100. In the initial, unactivated configuration, the elements 1110 lie within recesses 1111 formed in the outer surface of the casing 1100 so as to present a substantially flush outer surface. The elements 1110 have metal walls provided with an outer elastomer covering.

A previous cementing operation will have filled the annulus between the inner and outer casing 1100, 1102 to a level at or above the cement ports 1106.

An opening dart or bomb 1112 is then pumped into the casing 1100, ahead of a volume of cleaning fluid. As illustrated in FIG. 26*b*, the dart 1112 lands on a profile 1114 in the lower end of the sleeve 1104. The fluid pressure acting downwards on the dart 1112, combined with the momentum of the following column of fluid, shears the pins retaining the sleeve 1104 relative to the casing 1100, such that the sleeve 1104 moves downwards, uncovering the cement ports 1106 and aligning the inflation ports 1108 with corresponding sleeve ports 1116, as illustrated in FIG. 26*b*. The cleaning fluid then inflates the elements 1110, the elements 1110 being configured to retain the inflated extended form, for example by provision of one-way valves in the ports 1108, or by forming the walls of the elements 1110 of a material which is plastically deformed and then retains the fluid pressure-induced deformation. Cleaning fluid is pumped into the casing 1100 and circulates through the open cement ports 1106 to circulate out any excess cement that has gathered above the element from the previous cementing operation.

After the cleaning operation has been completed, a volume of cement slurry is pumped down through the casing 1100 and into the annulus through the ports 1106, above the activated elements 1110. The volume of cement may be followed by a dart which closes the cement ports 1106 and thus retains the column of cement slurry now in the annulus above the ports 1106.

Figure 26D:
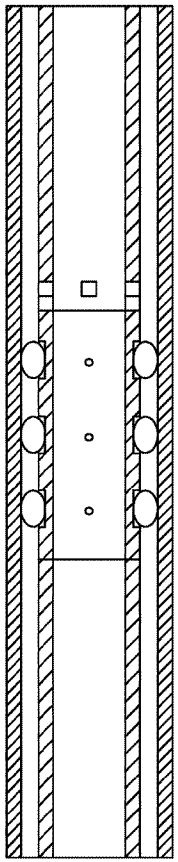
FIGS. 26*a* to 26*d* are sectional view of a cementing arrangement in accordance with an embodiment of the present invention.
Figure 26C:
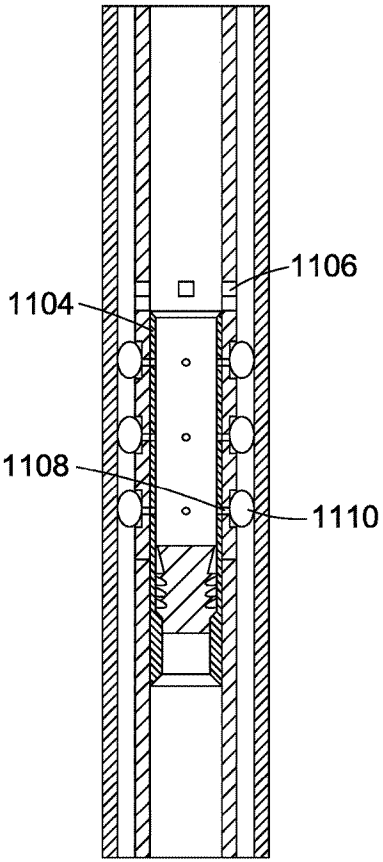
Figure 26B:
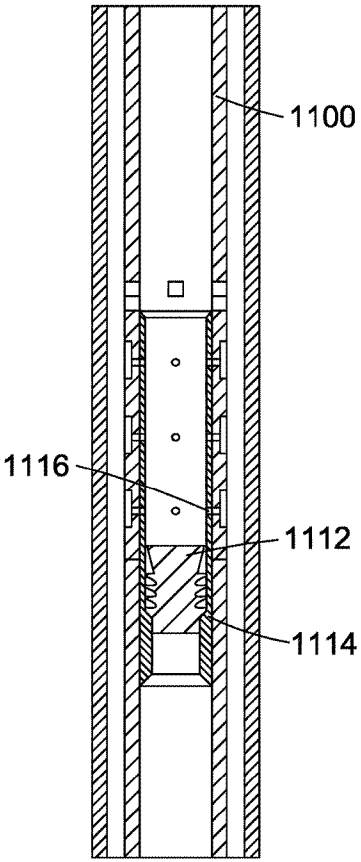
Figure 26A:
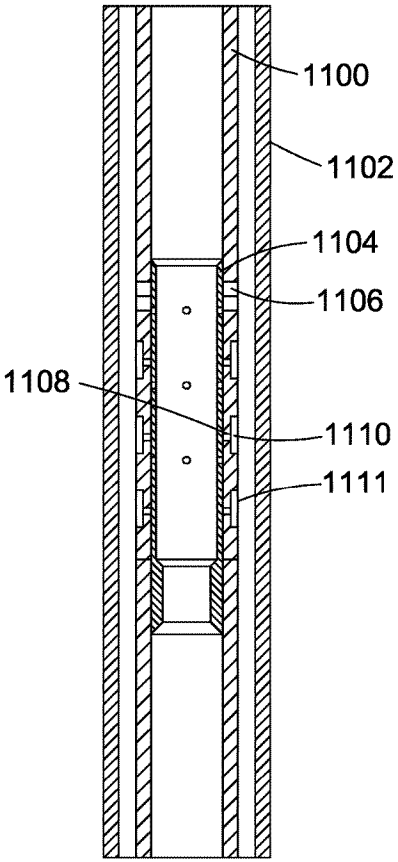

After completion of the cementing operation, the various plugs, the sleeve 1104 and any residual cement within the casing 1100 may be drilled out, as illustrated in FIG. 26*d*.

Thus, this arrangement allows cement slurry to be flowed into an upper annulus, while the hydraulic head created by the cement slurry in the upper annulus is isolated from the cement slurry in the lower annulus by the inflated elements 1110. The inflated elements 1110 also provide a secondary barrier to prevent fluid flowing up the annulus from a lower formation.

Figure 27:
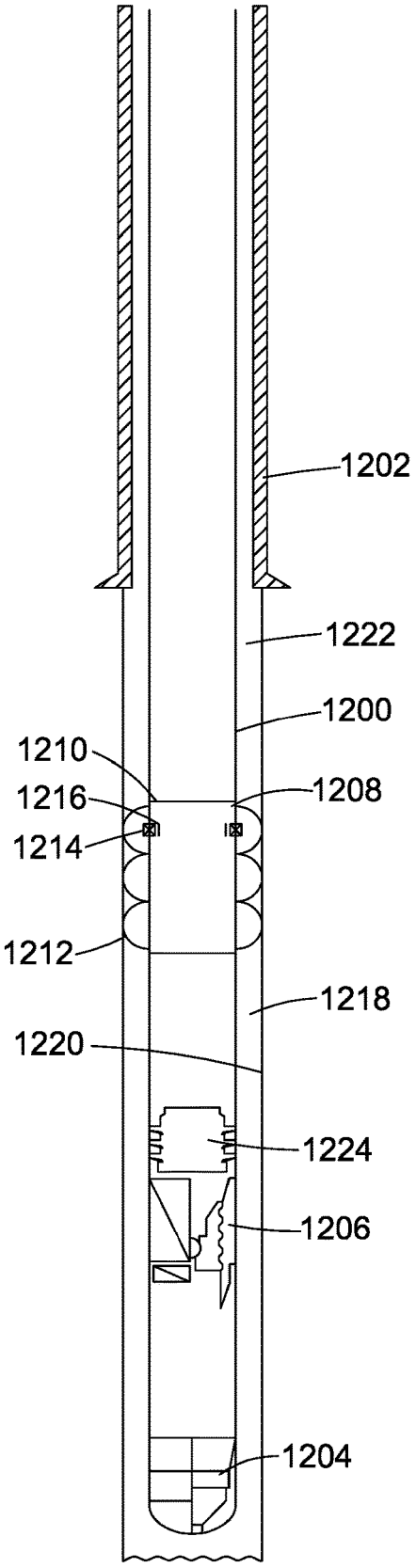
FIG. 27 is a schematic illustration of a cementing arrangement in accordance with another embodiment of the invention.

Reference is now made to FIG. 27 which illustrates a cementing arrangement in accordance with another embodiment of the present invention. The Figure illustrates apparatus suitable for use in cementing an inner casing 1200 within an outer casing 1202, with the lower end of the inner casing 1200 extending into an unlined bore section. A conventional shoe 1204 and a float collar 1206 are provided towards the leading end of the casing 1200, and an annular barrier 1208 is provided above the float collar 1206. The barrier 1208 has a tubular body 1210 for incorporation in the casing 1200 and carries three annular inflatable elements 1212 mounted externally of the body 1210. Fluid communication between the casing bore 1214 and the elements 1212 is provided via respective one-way valves 1214, initially closed by burst discs 1216.

Figure 28A:
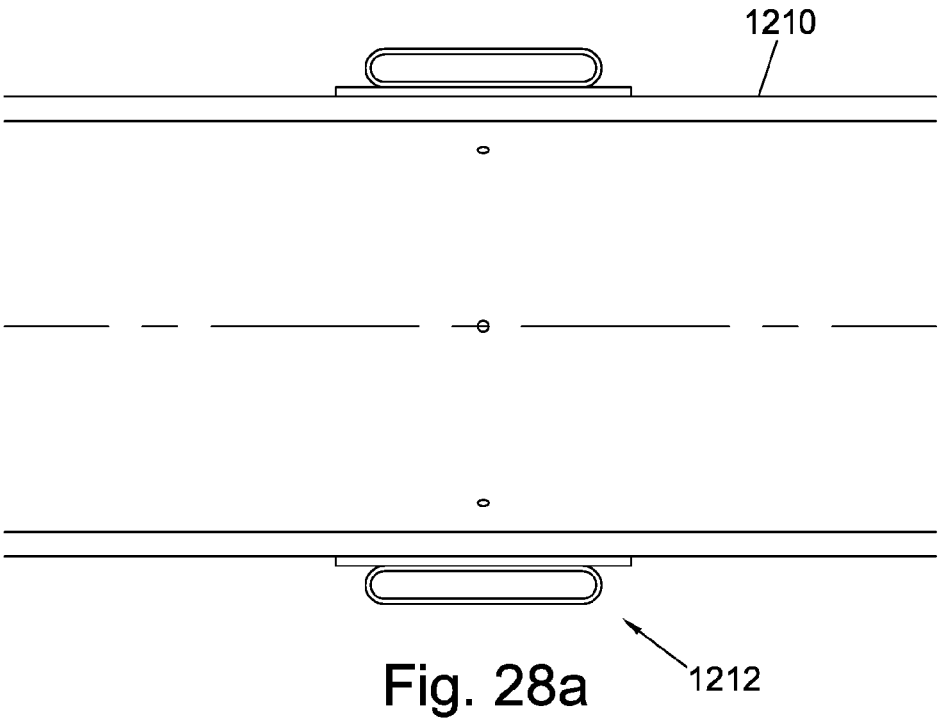
FIGS. 28*a* and 28*b* of the drawings are schematic illustrations showing certain features of one of the inflatable elements of the arrangement of FIG. 27.
Figure 28B:
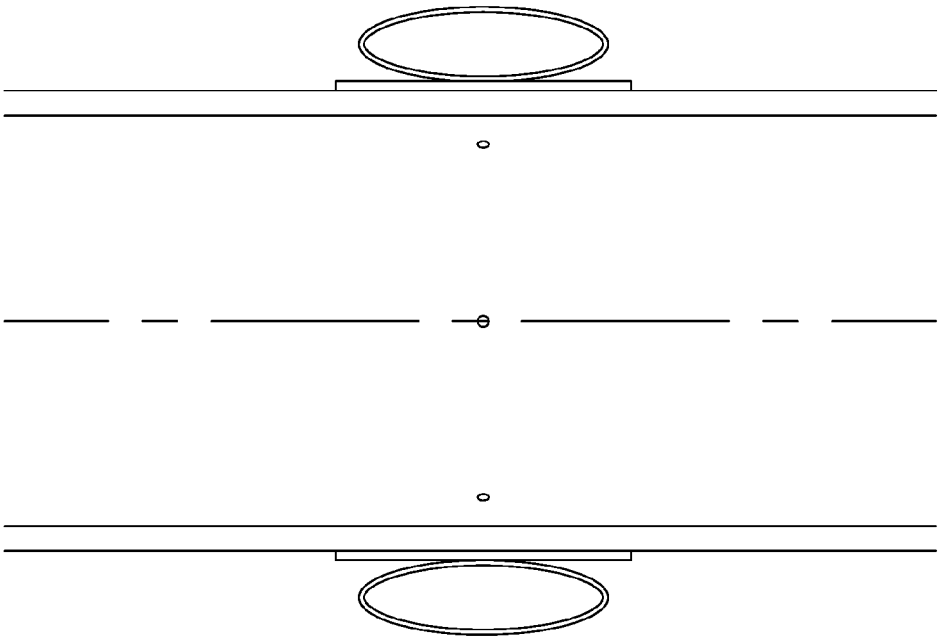

Reference is also now made to FIGS. 28*a* and 28*b* of the drawings, which are schematic illustrations showing certain features of one of the elements 1212. In particular, the element 1212 is constructed by welding a donut-shaped hollow metal chamber to a collar, which collar is then welded to the body 1210. As is evident from FIG. 28*b*, only the centre of the inner wall of the chamber is welded to the collar, such that the chamber wall is not restrained from deforming when the chamber is inflated.

FIG. 27 illustrates the arrangement following a cementing operation, with the elements 1212 fully inflated and extending into the cement-filled annulus 1218. As with the apparatus described above with reference to FIG. 26, the inflated elements 1212 provide an additional seal between the casing 1200 and the bore wall 1220 and also assist in supporting the column of cement slurry 1222 as the cement sets.

Initially, and during run-in, the elements 1212 are in a deflated retracted configuration, such that cement slurry that has been pumped down through the casing 1200 may pass through the float collar 1206 and the shoe 1204 and then into and up the annulus 1218. The cement slurry volume is followed into the casing 1200 by a solid wiper plug 1224, which ultimately lands on the collar 1206. The casing 1200 is then tested for pressure integrity. The burst discs 1216 are configured to fail at this test pressure, such that fluid in the casing bore will then inflate the elements 1212, and the arrangement will assume the configuration as illustrated in FIG. 27.

Although only a single barrier 1208 providing a seal with an open hole section, one or more barriers could equally well be provided at other locations, and utilized to provide a casing-to-casing seal.

The invention claimed is:

1. A downhole apparatus comprising:

a sand screen including a filter media and at least one inflatable element;

a barrier constructed of an elastomer sleeve and mounted on at least an end portion of the sand screen, wherein the barrier and the sand screen have an initial retracted configuration and are movable in response to inflation of the inflatable element to an extended configuration for engaging a surrounding bore wall to prevent fluid flow with the elastomer sleeve and thereby providing zonal isolation, wherein the barrier comprises a swellable material, the barrier configured for allowing a degree of extension of the barrier by inflation of the inflatable element, and a further degree of extension through swelling of the swellable material.

2. The downhole apparatus of claim 1, wherein the barrier is mounted around the at least an end portion of the sand screen.

3. The downhole apparatus of claim 1, wherein the barrier is positioned to at least partially cover a portion of the filter media of the sand screen.

4. The downhole apparatus of claim 3, wherein the barrier is positioned to partially cover a portion of the sand screen, thereby defining a non-covered portion of the sand screen for allowing fluid flow from an adjacent formation, through the non-covered portion, and into the sand screen.

5. The downhole apparatus of claim 1, wherein the sand screen comprises a non-extendable portion and an extendable portion such that a transition area is defined therebetween, and the transition area includes the at least end portion of the sand screen.

6. The downhole apparatus of claim 5, wherein the barrier is configured for preventing fluid flow through the transition area of the sand screen.

7. The apparatus of claim 1, wherein the barrier is positioned over a valve that controls a flow of production fluid into a base pipe, offering a degree of protection for the valve and assisting in balancing flow from a formation, through the bore wall, into and axially along the sand screen, and into a portion of the sand screen covered by the barrier.

8. The apparatus of claim 7, wherein the barrier is configured to prevent fluid from flowing radially and directly into the valve and allow the fluid to flow axially before reaching the valve.

9. The downhole apparatus of claim 1, wherein at least a portion of the barrier shares a common inflatable element with the sand screen, and the portion of the barrier is configured for expansion to the extended configuration.

10. The downhole apparatus of claim 1, wherein an inner sleeve is located externally of the inflatable element and an outer sleeve is located externally of the inner sleeve.

11. The downhole apparatus of claim 1, wherein an outer surface of the barrier comprises at least one of a rib, a plurality of ribs, and multiple circumferential ribs.

12. The downhole apparatus of claim 1, wherein the sand screen comprises a base pipe, and wherein the at least one inflatable element includes a plurality of inflatable elements extending axially along an outer surface of the base pipe.

13. The downhole apparatus of claim 12, comprising a support layer located externally of the inflatable elements, wherein the support layer comprises support strips arranged side-by-side and extending axially along the inflatable elements.

14. The downhole apparatus of claim 13, wherein the support strips are circumferentially offset relative to the inflatable elements.

15. The downhole apparatus of claim 13, wherein the support layer is configured to support a filter media in the form of a weave.

16. A method of lining a bore, the method comprising the steps of:

mounting a barrier on at least an end portion of a sand screen, the barrier including a swellable material and the sand screen including at least one inflatable element;

running the sand screen and the barrier into a bore in an initial retracted configuration; and then inflating the at least one inflatable to extend the barrier and the sand screen; and further extending the barrier by exposing the swellable material to a swelling activator to engage a surrounding bore wall in an extended configuration to thereby prevent axial movement of fluid past the barrier for providing zonal isolation.

17. The method of claim 16, comprising the step of mounting the barrier around the at least end portion of the sand screen.

18. The method of claim 16, comprising the step of positioning the barrier to at least partially cover a portion of the sand screen, thereby preventing fluid flow through the barrier, and allowing fluid to flow from a formation, through the bore wall, into and axially along the sand screen, and into a portion of the sand screen covered by the barrier.

19. The method of claim 16, comprising the steps of extending an extendable portion of the sand screen and maintaining a non-extendable portion of the sand screen in a non-extended configuration and configuring the barrier to prevent fluid flow through at least a transition area of the sand screen between the non-extendable portion and the extendable portion of the sand screen.

20. The method of claim 16, comprising the steps of mounting the barrier over a flow control valve in the base pipe and preventing fluid flow radially through the flow control valve and allowing fluid to flow into and axially along the sand screen before reaching the valve.

21. The method of claim 16, comprising the steps of providing the barrier and the sand screen on a single tubing section or joint, and inflating a common inflatable element to extend the barrier and sand screen.

22. The method of claim 16, comprising the step of selectively extending a plurality of isolation barriers at least one of simultaneously and individually in a desired sequence.

23. A downhole apparatus for isolating a section of a bore, comprising:

a base pipe;

a plurality of inflatable elements extending axially along an outer surface of the base pipe;

a sand screen mounted around the inflatable elements;

a bore wall surrounding the sand screen; and a barrier constructed of an elastomer sleeve mounted on at least an end portion of the sand screen, wherein the barrier comprises a swellable material, the portion of the barrier mounted on the end portion of the sand screen being radially extendable, and the sand screen having an initial retracted configuration and, responsive to inflation of the inflatable elements, an extended configuration, the barrier configured for allowing a degree of extension of the barrier by inflation of the inflatable elements, and a further degree of extension through swelling of the swellable material such that the barrier seals against the bore wall to prevent axial movement of fluid past the barrier.

24. The downhole apparatus of claim 23, comprising a plurality of support members located externally of the inflatable elements and internally of the sand screen.

* * * * *